US008773406B2

(12) United States Patent
Yang et al.

(10) Patent No.: US 8,773,406 B2
(45) Date of Patent: Jul. 8, 2014

(54) ORGANIC ELECTROLUMINESCENT DISPLAY

(75) Inventors: Sun A Yang, Yongin-si (KR); Byoung Deog Choi, Yongin-si (KR)

(73) Assignee: Samsung Display Co., Ltd., Giheung-Gu, Yongin, Gyeonggi-Do (KR)

( * ) Notice: Subject to any disclaimer, the term of this patent is extended or adjusted under 35 U.S.C. 154(b) by 1882 days.

(21) Appl. No.: 11/790,658

(22) Filed: Apr. 26, 2007

(65) Prior Publication Data

US 2008/0169754 A1 Jul. 17, 2008

(30) Foreign Application Priority Data

Jan. 15, 2007 (KR) ..... 10-2007-0004433

(51) Int. Cl.
*G09G 3/32* (2006.01)

(52) U.S. Cl.
USPC ..... 345/204; 345/46; 345/76; 345/82

(58) Field of Classification Search
USPC ..... 345/76, 82; 313/504
See application file for complete search history.

(56) References Cited

U.S. PATENT DOCUMENTS

| | | | | |
|---|---|---|---|---|
| 8,040,303 | B2 | 10/2011 | Kim et al. | |
| 2005/0062686 | A1* | 3/2005 | Iguchi | 345/46 |
| 2006/0244695 | A1* | 11/2006 | Komiya | 345/76 |

FOREIGN PATENT DOCUMENTS

| | | |
|---|---|---|
| JP | 2003-150108 | 5/2003 |
| JP | 2003-295824 | 10/2003 |
| JP | 2004-325885 | 11/2004 |
| JP | 2004-361737 | 12/2004 |
| JP | 2005-017438 | 1/2005 |
| JP | 2005-084119 | 3/2005 |
| JP | 2006-280585 | 10/2006 |
| KR | 10-2002-0067678 | 8/2002 |
| KR | 10-2004-0008684 | 1/2004 |
| KR | 10-2004-0009285 | 1/2004 |
| KR | 10-2004-0033679 | 4/2004 |
| KR | 10-2005-0123328 | 12/2005 |
| KR | 10-2006-0017207 | 2/2006 |
| KR | 10-2006-0114456 | 11/2006 |

* cited by examiner

*Primary Examiner* — Ha Tran T Nguyen
*Assistant Examiner* — Raj R Gupta
(74) *Attorney, Agent, or Firm* — Robert E. Bushnell, Esq.

(57) ABSTRACT

An organic electroluminescent display that can prevent decreases in an average luminance of an organic electroluminescent element thereof includes: a data line to supply a data signal; a scan line to supply a scan signal; a first switching element having a control electrode electrically coupled to the scan line, to transfer the data signal from the data line; a first driving transistor having a control electrode electrically coupled to the first switching element, to control a driving current of a first voltage line; a first capacitive element having a first electrode electrically coupled to the first voltage line and having a second electrode electrically coupled to a control electrode of the first driving transistor; an organic electroluminescent element, electrically coupled to the first driving transistor and a third voltage line, to display an image in response to a current supplied from the first driving transistor; and a second voltage line to supply a reverse bias voltage of a second voltage line to the organic electroluminescent element.

2 Claims, 17 Drawing Sheets

ORGANIC ELECTROLUMINESCENT DISPLAY

CLAIM FOR PRIORITY

This application makes reference to, incorporates the same herein, and claims all benefits accruing under 35 U.S.C.§119 from an application for ORGANIC ELECTROLUMINESCENCE DISPLAY earlier filed in the Korean Intellectual Property Office on 15 Jan. 2007 and there duly assigned Serial No. 10-2007-0004433.

BACKGROUND OF THE INVENTION

1. Field of the Invention

The present invention relates to an organic electroluminescent display, and more particularly, the present invention relates to an organic electroluminescent display that can prevent decreases in the average luminance thereof.

2. Description of the Related Art

An organic electroluminescent display is a display device for emitting light by electrically exciting fluorescent or phosphorescent materials. The organic electroluminescent display drives N×M number of organic electroluminescent display elements so as to display an image. As shown in FIG. 1*a*, the organic electroluminescent cell includes an anode (ITO), an organic thin film and a cathode (Metal). The organic thin film has a multi-layered structure including an emitting layer (EML) for emitting light with a combination of an electron and a hole, an Electron Transport Layer (ETL) for transporting electrons and a Hole Transport Layer (HTL) for transporting holes. The organic thin film may include an Electron Injecting Layer (EIL) for injecting electrons and a Hole Injecting Layer (HIL) for injecting holes.

An anode electrode is connected to a first voltage source to supply the holes to the light emitting layer (EML). A cathode electrode is connected to a second voltage source having an amplitude lower than that of the first voltage source to supply the electrons to the light emitting layer (EML). In other words, the anode electrode has a higher voltage potential of a positive(+) polarity and the cathode electrode has a lower voltage potential of a negative(−) polarity.

The hole transport layer (HTL) is supplied to the light emitting layer from the anode electrode by accelerating the supplied holes. The electron transport layer (ETL) accelerates the electrons supplied from a cathode electrode so that the electrons which are supplied from the electron transport layer (ETL) collide with the light emitting layer (EML). The electrons and holes are recombined in the light emitting layer (EML) so as to generate light. The light emitting layer (EML) is formed of organic materials and generates one of red (R) light, green (G) light or blue (B) light when the electrons and the holes are recombined.

In an organic electroluminescent element, negative carriers are located in the anode electrode of FIG. 1*b*, because a voltage supplied to the anode electrode is always set to be higher than that supplied to the cathode electrode. Positive carriers are located in the cathode electrode. If negative carriers in the anode electrode and positive carriers in the cathode electrode are kept for long time, the average luminance is decreased because the amount of movement of the electrons and holes is reduced.

SUMMARY OF THE INVENTION

Accordingly, an object of the present invention is to provide an organic electroluminescent display that can compensate for decreases in the average luminance thereof by causing a reverse current to flow in the organic electroluminescent element.

According to one aspect of the present invention, an organic electroluminescent display is provided including: a data line supplying a data signal; a scan line supplying a scan signal; a first switching element, electrically coupling a control electrode thereof to the scan line, transferring a data signal from the data line; a first driving transistor, electrically coupling a control electrode thereof to the first switching element, controlling a driving current of a first voltage line; a first capacitive element, electrically coupling a first electrode thereof to the first voltage line, and electrically coupling a second electrode thereof to a control electrode of the first driving transistor; an organic electroluminescent element, electrically coupling the first driving transistor to a third voltage line, displaying an image in response to a current supplied from the first driving transistor; and a second voltage line supplying a reverse bias voltage of a second voltage line to the organic electroluminescent element.

A voltage of the second voltage line may be less than that of the third voltage line electrically coupled to the organic electroluminescent element.

The second switching element may include a first electrode that is electrically coupled between the first driving transistor and the organic electroluminescent element, and a second electrode that is electrically coupled to the second voltage line.

The second switching element may electrically couple a control electrode thereof to a prior the scan line.

The organic electroluminescent display may further include a third switching element transferring a current supplied from the first driving transistor to the organic electroluminescent element.

The second and third switching elements each include control electrodes that are electrically coupled to the light emitting control line.

A third switching element may be an N-Channel transistor if the first and second switching element are P-Channel transistors.

According to another aspect of the present invention, anorganic electroluminescent display is provided including: a data line supplying a data signal; a scan line supplying a scan signal; a first switching element, electrically coupling a control electrode thereof to the scan line, transferring a data signal from the data line; a first driving transistor, controlling a driving current of the first voltage line; a second driving transistor electrically coupling a control electrode thereof to a control electrode of the first driving transistor, compensating a threshold voltage of data signal by supplying the first switching element; a first capacitive element electrically coupling a first electrode thereof to the first voltage line and electrically coupling a second electrode thereof to a control electrode of the first driving transistor; an organic electroluminescent element, electrically coupling the first driving transistor to a third voltage line, displaying an image in response to a current supplied from the first driving transistor; an second voltage line supplying a reverse bias voltage of a second voltage line to the organic electroluminescent element.

A voltage of the second voltage line may be less than that of the third voltage line electrically coupled to the organic electroluminescent element.

A control electrode of the second driving transistor may be electrically coupled to the first electrode connected to the first driving transistor.

The organic electroluminescent display may include the fourth switching element initializing a stored voltage of the first capacitive element by supplying voltage from the fourth voltage line.

The second switching element may include a first electrode that is electrically coupled between the first driving transistor and the organic electroluminescent element, and a second electrode that is electrically coupled to the second voltage line.

The fourth switching element may be electrically coupled between the second driving transistor and the fourth voltage line, and the second driving transistor may be electrically coupled between the first switching element and the first driving transistor.

The organic electroluminescent may include the third switching element transferring driving current of the first driving transistor to the organic electroluminescent element.

If the second and the fourth switching element are P-Channel transistors, but if the third switching element is a N-Channel transistor, the second switching element includes a first electrode that is electrically coupled between the third switching element and the organic electroluminescent element, and a second electrode that is electrically coupled to the second voltage line, the third switching element being electrically coupled between the first driving transistor and the organic electroluminescent element, and the third switching element including a control electrode that is electrically coupled to the scan line.

The second and fourth switching elements may include control electrodes that are electrically coupled to the prior scan line, and the third switching element may include a control electrode that is electrically coupled to a light emitting control line.

The organic electroluminescent element may include a seventh switching element, transferring driving current of the first driving transistor to the third switching element, the control electrode electrically coupled to the scan line.

According to still another aspect of the present invention, an organic electroluminescent display is provided including: a data line supplying a data signal; a scan line supplying a scan signal; a first switching element, electrically coupling a control electrode thereof to the scan line, transferring a data signal from the data line; a first driving transistor, electrically coupling a control electrode thereof to the first switching element, controlling a driving current of a first voltage line; a first capacitive element electrically coupling a first electrode thereof to the first voltage line and electrically coupling a second electrode thereof to a control electrode of the first driving transistor; an organic electroluminescent element, electrically coupled to the first driving transistor and to a third voltage line, displaying an image in response to a current supplied from the first driving transistor; an second voltage line supplying a reverse bias voltage of a second voltage line to the organic electroluminescent element.

A voltage of the second voltage line is less than that of the third voltage line electrically coupled to the organic electroluminescent element.

The second switching element includes a first electrode that is electrically coupled between the first driving transistor and the organic electroluminescent element, and a second electrode that is electrically coupled to the second voltage line.

The organic electroluminescent display may include a fifth switching element, coupling the first driving transistor into a diode configuration, and having a first electrode thereof electrically coupled to the control electrode of the first driving transistor, and a second electrode thereof electrically coupled to the second electrode of the first driving transistor.

The first driving transistor includes a first electrode that is electrically coupled to the first voltage line, and a second electrode that electrically couples the fifth switching element to the second electrode.

The organic electroluminescent display may include a sixth switching element supplying voltage of the first voltage line to the first capacitive element.

The sixth switching element includes a first electrode that is electrically coupled to the first voltage line, and a second electrode that is electrically coupled between the first and second capacitive element.

The organic electroluminescent display may include a fourth switching element, transferring driving current of the first diving transistor to the organic electroluminescent element.

If the first and second, fifth and sixth switching elements are P-Channel transistors, the third switching element may be N-Channel transistor, each control electrode of the second, sixth and fifth switching elements may be electrically coupled to the prior scan line, and the control electrode of the third switching element may be coupled to an light emitting control line.

Each control electrodes of the second, sixth and fifth switching elements may be electrically coupled to the scan line, and the control electrode of the third switching element may be electrically coupled to the light emitting control line.

According to still another aspect of the present invention, an organic electroluminescent display is provided including: a data line supplying a data signal; a scan line supplying a scan signal; a first switching element, electrically coupling a control electrode thereof to the scan line, transferring a data signal from the data line; a first driving transistor, electrically coupling a control electrode thereof to the first switching element, controlling a driving current of the first voltage line; a first capacitive element electrically coupled between the control electrode of the first driving transistor and the first voltage line, and a fifth switching element electrically coupling the first driving transistor into a diode configuration; an organic electroluminescent element displaying an image in response to a current supplied from the first driving transistor; and a second switching element supplying a reverse bias voltage of the second voltage line to the organic electroluminescent element.

A voltage of the second voltage line may be less than that of the third voltage line.

The second switching element includes a first electrode that is electrically coupled to the organic electroluminescent element, and a second electrode that is electrically coupled to a second voltage line.

The organic electroluminescent display may include a sixth switching element that is electrically coupled between the first driving transistor and the first voltage line, and a third switching element transferring driving current of the first driving transistor to the organic electroluminescent element.

The organic electroluminescent display may include a fourth switching element initializing a stored voltage of the first capacitive element by a voltage supplied from a fourth voltage line.

The fifth switching element may include a first electrode that is electrically coupled between the sixth switching element and the first driving transistor, and a second electrode electrically coupled to a control electrode of the first driving transistor.

The first switching element includes a first electrode that is electrically coupled to the data line, a second electrode that is electrically coupled between the first driving transistor and the third switching element.

The first, second and fifth switching elements may each include control electrodes that are electrically coupled to the scan line, and the sixth and third switching elements may each include control electrodes that are electrically coupled to the light emitting control line, and the fourth switching element may include a control electrode that is electrically coupled to the prior scan line.

The organic electroluminescent display may include a fourth switching element initializing a stored voltage of the first capacitive element electrically coupling the prior scan line, the fifth switching element may include a first electrode that is electrically coupled between the third switching element and the first driving transistor, and a second electrode that is electrically coupled to the control electrode of the first driving transistor, and the first switching element may include a first electrode that is electrically coupled to the data line, and a second electrode that is electrically coupled between the first driving transistor and the sixth switching element.

The fourth switching element includes a first electrode that is electrically coupled to the first capacitive element, and a second electrode that is electrically coupled to a control electrode as a diode structure.

The first, second and the fifth switching elements may each include control electrodes that are electrically coupled to the scan line, and the sixth and third switching elements may each include control electrodes that are electrically coupled to the light emitting control line.

The organic electroluminescent display may include a third capacitive element including a first electrode that is electrically coupled between the scan line and the control electrode of the first switching element and a second electrode that is electrically coupled to the first driving transistor.

The first, second and fifth switching elements may each include control electrodes that are electrically coupled to the scan line, the sixth and third switching elements may each include control electrodes that are electrically coupled to the light emitting control line, the fourth switching element may include a control electrode that is electrically coupled to the scan line, and the second switching element may include a control electrode that is electrically coupled to the scan line.

BRIEF DESCRIPTION OF THE DRAWINGS

A more complete appreciation of the present invention and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

Figure 1A:
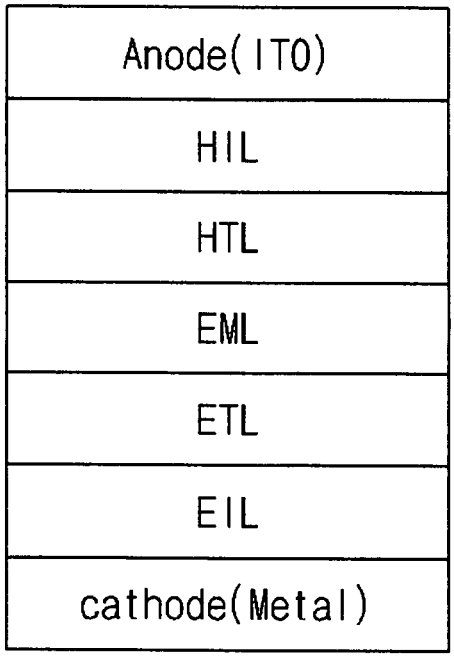
FIG. 1*a* and FIG. 1*b* are diagrams of a light emitting element.

Hereinafter, exemplary embodiments of the present invention are described in detail below with reference to the accompanying drawing. However, the present invention is not limited to the embodiments disclosed hereinafter, but can be implemented in diverse forms. The matters defined in the description, such as the detailed construction and elements, are merely specific details provided to assist those of ordinary skill in the art in a comprehensive understanding of the present invention, and the present invention is only defined within the scope of the appended claims. In the entire description of the present invention, the same drawing reference numerals are used for the same elements across various figures.

An organic electroluminescent element includes an anode, an organic layer and a cathode. The organic layer may include an emitting layer (EML) for emitting light by combining electrons with holes to form excitons, an electron transport layer (ETL) for transporting the electrons and a hole transport layer (HTL) for transporting holes. A electron injecting layer (EIL) for injecting the electrons is formed on one side of the electron transport layer, and a hole injecting layer (HIL) for injecting holes is formed on one side of the hole transport layer. A phosphorescence organic electroluminescent element may be formed selectively between the emitting layer (EML) and the electron transport layer (ETL), and a electron blocking layer (EBL) may be formed selectively between the emitting layer (EML) and the hole transport layer (HTL).

The organic layer may be formed as a structure for a slim type organic electroluminescent element to decrease the thickness by mixing two kinds of layer. For example, the organic layer may be selectively formed as a structure for a hole injection transport layer (HITL) that simultaneously forms the hole injection layer and the hole transport layer, and a structure for a electron injection transport layer (EITL) that simultaneously forms the electron injection layer (EIL) and the electron transport layer (ETL). The slim type organic electroluminescent element can be used to increase light emitting efficiency.

Also, a buffer layer may be formed between the anode and the light emitting layer as a selective layer. The buffer layers is divided into an electron buffer layer for buffering the electrons and the hole buffer layers for buffering the holes. The electron buffer layer may be selectively formed between the cathode and the electron injection layer (EIL). A stack structure of the organic layer may be the light emitting layer (EML)/electron transport layer (ETL)/electron buffer layer/cathode. The hole buffer layer may be selectively formed between the anode and the hole injection layer (HIL). A stack structure of the organic layer may be anode/hole buffer layer/hole transport layer (HTL)/emitting layer.

The structure is satisfied by the following stack structure.

a) normal stack structure
   1) anode/hole injection layer/hole transport layer/emitting layer/electron transport layer/electron injection layer/cathode
   2) anode/hole buffer layer/hole injection layer/hole transport layer/emitting layer/electron transport layer/electron injection layer/cathode
   3) anode/hole injection layer/hole transport layer/emitting layer/electron transport layer/electron injection layer/electron buffer layer/cathode
   4) anode/hole buffer layer/hole injection layer/hole transport layer/emitting layer/electron transport layer/electron injection layer/electron buffer layer/cathode
   5) anode/hole injection layer/hole buffer layer/hole transport layer/emitting layer/electron transport layer/electron injection layer/cathode
   6) anode/hole injection layer/hole transport layer/emitting layer/electron transport layer/electron buffer layer/electron injection layer/cathode b) normal slim structure
   1) anode/hole injection transport layer/emitting layer/electron transport layer/electron injection layer/cathode
   2) anode/hole buffer layer/hole injection transport layer/emitting layer/electron transport layer/electron injection layer/cathode
   3) anode/hole injection layer/hole transport layer/emitting layer/electron injection transport layer/electron buffer layer/cathode
   4) anode/hole buffer layer/hole transport layer/emitting layer/electron injection transport layer/electron buffer layer/cathode
   5) anode/hole injection transport layer/hole buffer layer//emitting layer/electron transport layer/electron injection layer/cathode
   6) anode/hole injection layer/hole transport layer/emitting layer/electron buffer layer/electron injection transport layer/cathode c) inverted stack structure
   1) cathode/electron injection layer/electron transport layer/emitting layer/hole transport layer/hole injection layer/anode
   2) cathode/electron injection layer/electron transport layer/emitting layer/hole transport layer/hole injection layer/hole buffer layer/anode
   3) cathode/electron buffer layer/electron injection layer/electron transport layer/emitting layer/hole transport layer/hole injection layer/cathode
   4) cathode/electron buffer layer/electron injection layer/electron transport layer/emitting layer/hole transport layer/hole buffer layer/anode
   5) cathode/electron injection layer/electron transport layer/emitting layer/hole transport layer/hole buffer layer/hole injection layer/anode
   6) cathode/electron injection layer/electron buffer layer/electron transport layer/emitting layer/hole transport layer/electron injection layer/anode d) inverted slim structure
   1) cathode/electron injection layer/electron transport layer/emitting layer/hole injection transport layer/anode
   2) cathode/electron injection layer/electron transport layer/emitting layer/hole injection transport layer/hole buffer layer/anode
   3) cathode/electron buffer layer/electron injection transport layer/emitting layer/hole transport layer/hole injection layer/cathode
   4) cathode/electron buffer layer/electron injection transport layer/emitting layer/hole transport layer/hole buffer layer/anode
   5) cathode/electron injection layer/electron transport layer/emitting layer/hole buffer layer/hole injection transport layer/anode
   6) cathode/electron injection transport layer/electron buffer layer/emitting layer/hole transport layer/electron injection layer/anode As described above, a driving technique for an organic electroluminescent element includes a Passive Matrix (PM) technique and an Active Matrix (AM) technique. The PM technique forms an anode and a cathode so as to be orthogonal to each other and selects a line. Accordingly, a production process is simple and investment cost is decreased, but current consumption is large when implementing a large screen. On the other hand, the AM technique forms an active device, such as a Thin Film Transistor (TFT) and a capacitance device on each pixel, thereby resulting in a low current consumption, high image quality and life.

As described above, the AM technique uses a pixel circuit based on an organic electroluminescent element and a TFT. Crystallization of a TFT of an organic electroluminescent display includes Excimer Laser Crystallization (ELC) using an excimer laser, Metal Induced Crystallization (MIC) using a promoting material, and Solid Phase Crystallization (SPC). Additionally, crystallization of a TFT of an organic electroluminescent display includes Sequential Lateral Solidification (SLS) using a mask in the conventional ELA method. Also a crystallization method for crystallizing micro silicon having a grain size between amorphous silicon (a-Si) and polysilicon includes a thermal crystallization method and a laser crystallization method.

Micro silicon has a grain size in a range of 1 nm to 100 nm. Micro silicon has an electron mobility in a range of 1 to below 50 and a hole mobility in a range of 0.01 to below 0.2. Micro silicon has a grain size which is small as compared to polysilicon. Accordingly, the electrons are not affected by the projecting part between the grains being too small.

The thermal crystallization method for crystallizing micro silicon includes a method of obtaining a crystallization structure while depositing amorphous silicon and a reheating method.

The laser crystallization method for crystallizing the micro silicon deposits the amorphous silicon using a Chemical Vapor Deposition (CVD) method and crystallizes the amorphous silicon using a laser. A diode laser is mainly used. The diode laser uses a red wavelength of 800 nm. The red wavelength contributes to crystallizing the micro silicon grain uniformly.

Among the methods for crystallizing a TFT into the polysilicon, Excimer Laser Crystallization (ELC) has been mainly used. ELC can use a crystallization method of a conventional poly Liquid Crystal Display (LCD) as well as a simple processing method. Furthermore, the technology development for the processing method has already been completed.

Metal Induced Crystallization (MIC) is one method capable of effecting crystallization at a low temperature without using ELC. MIC deposits or spin-coats a metal catalyst metal, such as Ni, Co, Pd and Ii, so as to enable the metal catalyst metal to directly penetrate into a surface of the amorphous silicon (a-Si) and crystallizes the amorphous silicon while a phase of the amorphous silicon is being changed.

Furthermore, MIC can substantially prevent a contaminant, such as nickel-silicide, from entering a specific region of the TFT using a mask, when a metal layer is formed on the surface of the amorphous silicon. This MIC is referred to as Metal Induced Lateral Crystallization (MILC). The mask of the MIC can be a shadow mask. The shadow mask may be a line-type mask or a dot type mask.

Furthermore, metal induced crystallization with capping layer (MICC) is an MIC in which a capping layer is inserted first when the metal catalyst layer is deposited or spin-coated on the surface of the amorphous silicon so that the amount of the metal catalyst in the amorphous silicon is controlled. The capping layer can be a silicon nitride film. The amount of the metal catalyst transferred from the metal catalyst layer to the amorphous silicon is dependant upon the thickness of the silicon nitride film. The metal catalyst being induced into the silicon nitride film may be wholly formed on the silicon nitride film, and selectively formed using the shadow mask. The amorphous silicon is crystallized into polysilicon by the metal catalyst layer and then the capping layer can be selectively removed. The capping layer can be removed using a wet etching or a dry etching. Additionally, after the polysilicon is formed, a gate insulation film is formed and then a gate electrode is formed on the gate insulation film. An interlayer insulation film may be formed on the gate electrode. After forming a via-hole on the interlayer insulation film, impurities are injected into the polysilicon crystallized through the via-hole so as to enable the metal catalytic impurities in the inside of the polysilicon to be removed. This is referred to as "Gettering process". The Gettering process includes a process of injecting the impurities and a heating process of heating the TFT at a low temperature. The gettering process can produce a high quality TFT.

Figure 2:
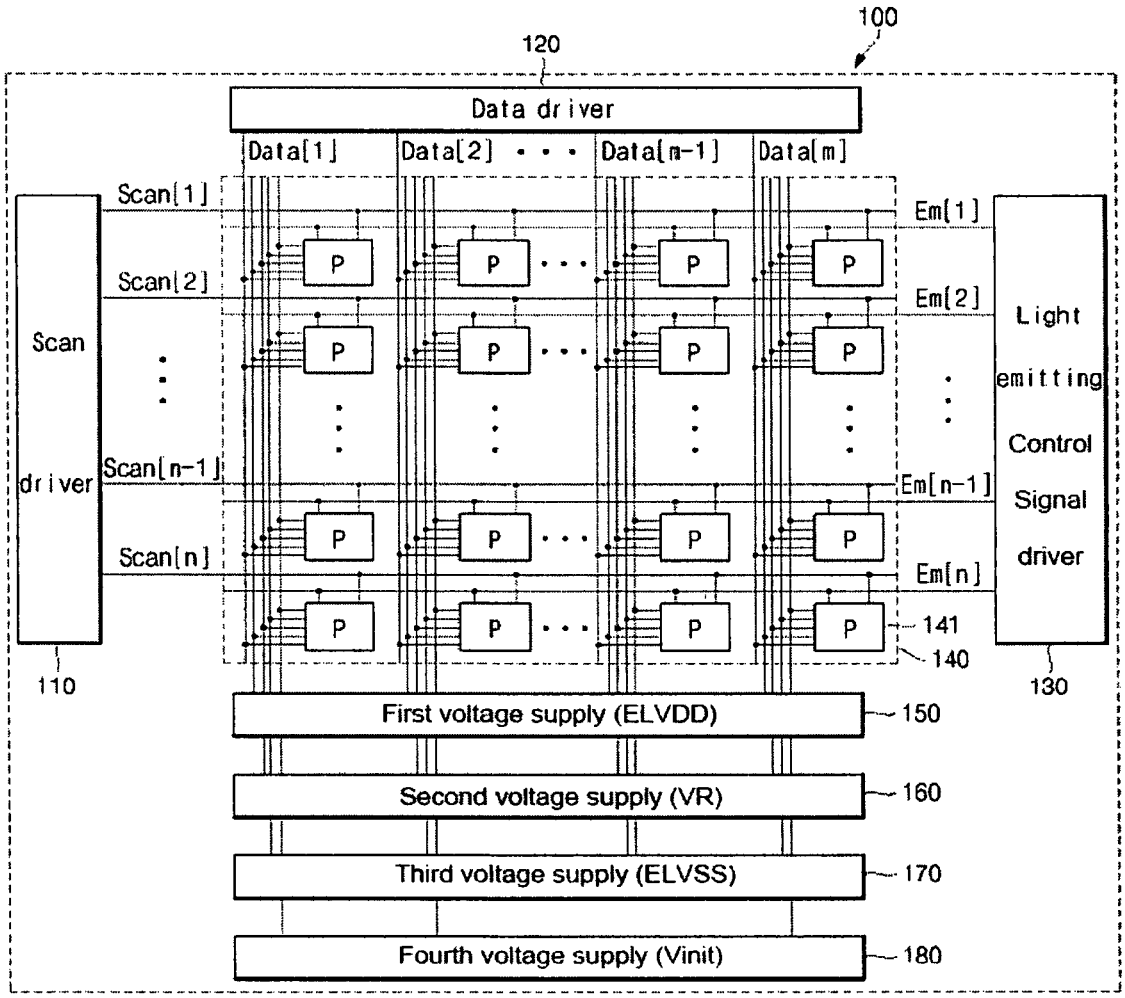
FIG. 2 is a block diagram of an organic electroluminescent display according to the present invention.

FIG. 2 is a block diagram of an organic electroluminescent display according to an embodiment of the present invention;

Referring to FIG. 2, a flat panel device 100 includes a scan driver 110, a data driver 120, a light emitting control signal driver 130, an organic electroluminescent display panel (hereinafter, referred to as a panel), 140, a first voltage supply 150, a second voltage supply 160, a third voltage supply 170, and a fourth voltage supply 180.

The scan driver 110 sequentially supplies a scan signal through the plurality of scan lines (Scan [1], Scan [2], . . . , Scan [n]) to the panel 140.

The data driver 120 supplies a data signal through the plurality of data lines (Data [1], Data [2], . . . , Data [m]) to the panel 140.

The light emitting control signal driver 130 sequentially supplies a light emitting control signal through the plurality of light emitting control signal lines (Em [1], Em [2], . . . , Em [n]) to the panel 140.

The panel 140 includes a pixel circuit 141 which is defined by a plurality of the scan lines (Scan [1], Scan [2], . . . , Scan [n]) arranged in a column direction, a plurality of the light emitting control lines (Em [1], Em [2], . . . , Em [n]), a plurality of the data lines (Data [1], Data [2], . . . , Data [m]) arranged in a row direction.

The pixel circuit 141 is arranged in the pixel area which is defined by two neighboring scan lines (or the light emitting signal control line) and two neighboring data lines. The scan signal is supplied by the scan driver 110 to the scan lines (Scan[1], Scan [2], . . . , Scan [n]), and the data signal is supplied by the data driver 120 to the data lines (Data [1], Data [2], . . . , Data [m]), and the light emitting control signal is supplied by the light emitting control signal driver 130 to the light emitting control signal lines (Em [1], Em [2], . . . , Em [n]).

The first, second, third and fourth voltage supplies 150, 160, 170 and 180 supply first, second, third and fourth voltages to each pixel circuit 141 in the panel 140.

Figure 3:
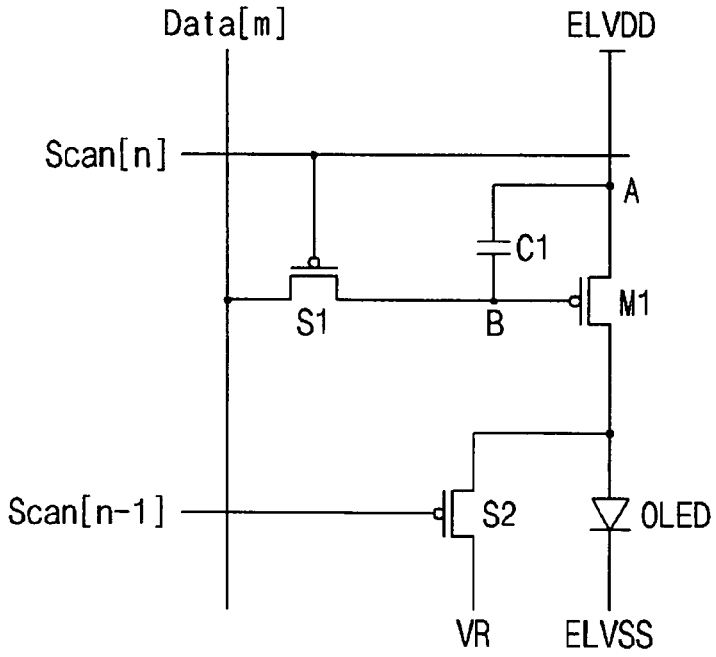
FIG. 3 is a circuit diagram of a pixel circuit of an organic electroluminescent display according to one exemplary embodiment of the present invention.

FIG. 3 is a circuit diagram of a pixel circuit of an organic electroluminescent display according to another exemplary embodiment of the present invention. The pixel circuit is one of the pixel circuits 141 of the organic electroluminescent display 100 of FIG. 2

Referring to FIG. 3, the pixel circuit of the organic electroluminescent display includes a scan line (Scan [n]), a prior scan line (Scan [n−1]), a data line (Data [m]), a first voltage line (ELVDD), a second voltage line (VR), a third voltage line (ELVSS), a first switching element (S1), a second switching element (S2), a first driving transistor (M1), a first capacitive element (C1), and an organic electroluminescent element. For simplicity, the organic electroluminescent element in this and all of the following descriptions and drawing figures will be referred to as an Organic Light Emitting Diode (OLED). The organic electroluminescent element of the present invention, however, is not limited to OLEDs.

The Scan line (Scan [n]) supplies the scan signal to a control electrode of the first switching element (S1) that selects the OLED to emit light. The scan line (Scan [n]) is electrically coupled to a scan driver (element 110 of FIG. 2) for generating the scan signal.

The prior scan line (Scan [n−1]) is indicated as Scan [n−1] from the point that a previously selected n−1-th scan line is commonly used. The prior scan line (Scan [n−1]) controls an operation of the second switching element (S2) to supply the second voltage to the OLED.

The data line (Data [m]) supplies a data signal (Voltage) that is proportional to the light emitting luminance to a second electrode of the first capacitive element (C1) and a control electrode of the first driving transistor (M1). The data line (Data [m]) is electrically coupled to the data driver (element 120 of FIG. 2) for generating the data signal.

The first voltage line (ELVDD) supplies the first voltage to the OLED. The first voltage line (ELVDD) is coupled to the first voltage supply (element 150 of FIG. 2) for supplying the first voltage.

The second voltage line (VR) supplies the second voltage to the OLED. The second voltage line (VR) is coupled to the second voltage supply (element 160 of FIG. 2) for supplying the second voltage.

The third voltage line (ELVSS) supplies the third voltage to the OLED. The third voltage line (ELVSS) is coupled to the second voltage supply (element 170 of FIG. 2) for supplying the second voltage. The first voltage is at a high level as compared to the second voltage, and the third voltage is at a low level as compared to the second voltage, and supplies a negative voltage to the OLED.

The first switching element (S1) includes a first electrode (drain electrode or source electrode) that is electrically coupled to the data line (Data [m]), and a second electrode (source electrode or drain electrode) that is electrically coupled to a control electrode (gate electrode) of the first driving transistor (M1), and to a control electrode that is electrically coupled to the scan line (Scan [n]). The first switching element (S1) supplies the data signal to the second electrode (B) of the first capacitive element (C1) and the control electrode of the first driving transistor (M1) when the first switching element (S1) is turned on.

The second switching element (S2) includes a first electrode (source electrode or drain electrode) that is electrically coupled to the second voltage line (VR), and a second electrode (drain electrode or source electrode) that is electrically coupled to an anode of the OLED, and a control electrode that is electrically coupled to a prior scan line (Scan [n−1]). When the second switching element (S2) is turned on by the scan signal of the low level from the prior scan line (Scan [n−1]) being turned on, the second voltage is supplied to the OLED. The second voltage is a negative voltage and enables the current to reversely flow to the OLED. Generally, when a high voltage is supplied to an anode (ITO of FIG I) and a low voltage is supplied to a cathode (Metal of FIG. 1), negative (−) carriers are located in the anode (ITO) and positive (+) carriers are located in the cathode (Metal), and negative and positive carriers stay at but are not moved to the emitting layer (EML). The fixed carriers cause an average luminance of the organic electroluminescent element to be decreased. To compensate for the decrease in the average luminance, the current reversely flows to the OLED. The fixed negative (−) and positive (+) carriers are reduced, and carriers which are moved to emitting layer are increased. Light is emitted by the OLED because fixed carriers are moved to the emitting layer (EML). The negative voltage is supplied at a time other than a light emitting time of the OLED. Then, the decrease in the average luminance is compensated for.

The first driving transistor (M1) includes a first electrode that is electrically coupled to the first voltage line (ELVDD), and a second electrode that is electrically coupled to an anode of the OLED, and a control electrode that is electrically coupled to the second electrode of the first switching element (S1). The first driving transistor (M1) is a P-type channel transistor and is turned on when a data signal of a low level (or a negative voltage) is supplied to a control electrode, and supplies a fixed quantity of current from the first voltage line to the OLED. A data signal of a low level (or a negative voltage) is supplied to the second electrode of the first capacitive element (C1) so as to be charged. Thus, a data signal of a low level (or a negative voltage) is continuously supplied to the control electrode of the first driving transistor (M1) by the charging voltage of the first capacitive element for a predetermined time.

The first driving transistor (M1) may be an amorphous silicon TFT, a polysilicon TFT, an organic TFT, a nano thin film semiconductor transistor or equivalents thereof. However, the present invention is not limited thereto.

Furthermore, if the first driving transistor (M1) is a polysilicon TFT, the first driving transistor (M1) may be formed by a laser crystallization method, a metal induced crystallization method, a high pressure crystallization method or equivalents thereof. However, the present invention is not limited thereto.

For reference, the laser crystallizing method crystallizes the amorphous silicon by scanning with an excimer laser, and the metal induced crystallization method crystallizes the amorphous silicon by placing a metal on the amorphous silicon and heating the metal to a predetermined temperature, and the high pressure crystallization method crystallizes the amorphous silicon by providing a fixed high-pressure to the amorphous silicon.

If the first driving transistor is manufactured by the metal induced crystallization method, the first driving transistor (M1) may include Nickel (Ni), cadmium (Cd), cobalt (Co), Titanium (Ti), palladium (Pd), tungsten (W) or equivalents thereof.

The first capacitive element (C1) includes a first electrode (A) that is electrically coupled between a second electrode (B) of the first switching element (S1) and a control electrode of the first driving transistor (M1), and a second electrode that is electrically coupled between the first electrode of the first driving transistor and the first voltage line (ELVDD).

The OLED includes an anode that is electrically coupled between the second electrode of the first driving transistor (M1) and the first electrode of the second switching element (S2), and a cathode that is electrically coupled to the third voltage line (ELVSS). The OLED emits light with a fixed brightness by current that is controlled through the first driving transistor (M1).

Figure 1B:
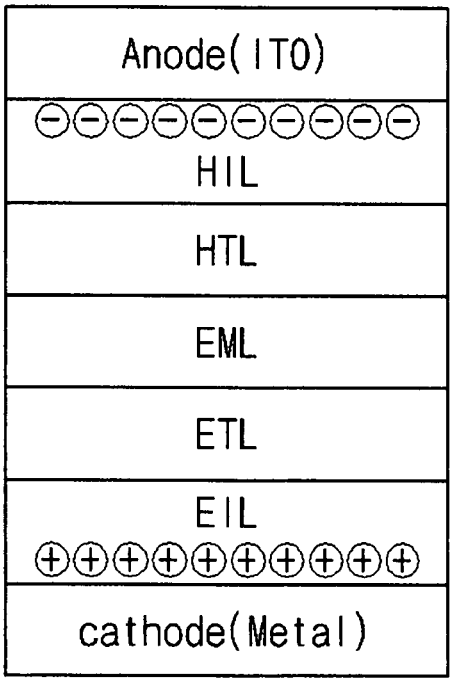

The OLED has an emitting layer (element EML of FIG. 1). The emitting layer (EML) may be fluorescent materials, phosphorescent materials, compounds or equivalents thereof. However, the present invention is not limited thereto.

The emitting layer (EML) may be red light-emitting materials, green light-emitting materials, blue light-emitting materials, compounds or equivalents thereof. However, the present invention is not limited thereto.

Figure 4:
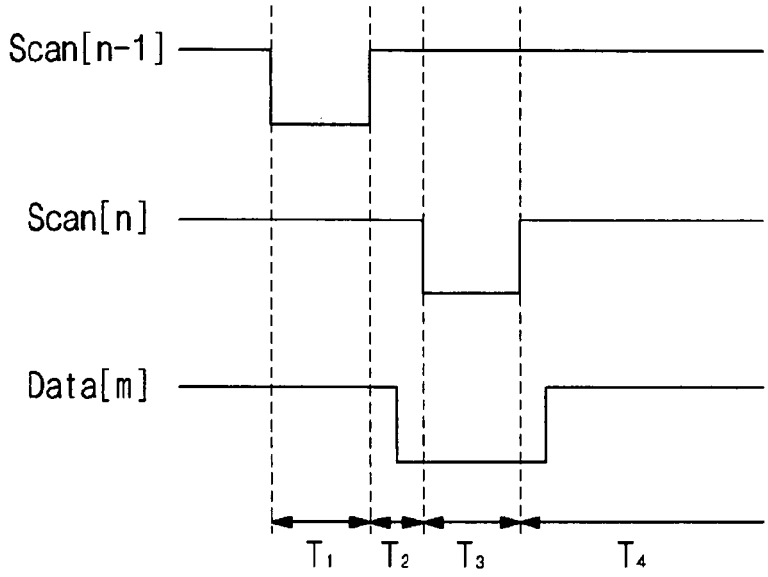
FIG. 4 is a waveform diagram of the driving timing of the pixel circuit of FIG. 3.

FIG. 4 is a waveform diagram of the driving timing of the organic electroluminescent display pixel circuit of FIG. 3.

For a negative bias period (T1), if the scan signal of a low level in a prior scan line (Scan [n−1]) is supplied to a control electrode of the second switching element (S2), the second switching element (S2) is turned on and thus supplies the second voltage to the OLED. The second voltage makes the current reversely flow to the OLED as a negative voltage. Generally, when a high voltage is supplied to an anode (element ITO of FIG. 1) and a low voltage is supplied to a cathode (element Metal of FIG. 1), negative (−) carriers are located in the anode (ITO) and positive (+) carriers are located in the cathode (Metal). The negative carriers and positive carriers stay but are not moved. The fixed carriers cause an average luminance of the OLED to be decreased. To compensate for the decrease in the average luminance, a current must reversely flow to the OLED. The fixed negative (−) and positive (+) carriers are decreased, and carriers which are moved to the emitting layer are increased. The emitting of light by the OLED actively occurs because fixed carriers are moved to an emitting layer (EML). As a result thereof, a decrease in the average luminance is compensated for.

For a delay period 1 (T2), a scan signal of the prior scan line (Scan [n−1]) is changed from a low level to a high level when a scan signal of the scan line (Scan [n]) is maintained at a high level. During the delay period 1(T2), a data voltage of the data line (Data [m]) is changed to a data voltage that corresponds to a pixel circuit connected to the scan line (Scan [n]). If there is no delay period 1(T2), the scan signal of the scan line (Scan [n]) changes to a low level before present data voltage is supplied, and the prior data voltage supplied to the data line (Data [m]) is supplied to the first driving transistor (M1) through the first switching element (S1).

For a program period (T3), if the scan signal of the scan line (Scan [n]) is changed to a low level, the first switching element (S1) is turned on. The data voltage of the data line (Data [m]) is transmitted to the first driving transistor (M1) through the first switching element (S1). Coincidentally, the first capacitive element (C1) charges to a voltage that corresponds to a data voltage difference between a first voltage from the data voltage line (Data [m]) and the first voltage from the first voltage line (ELVDD) and maintains the stored voltage for a constant period, and the OLED emits light by being supplied with a current ($I_{OLED}$) that corresponds to a gate-source voltage ($V_{GS}$) of the first driving transistor (M1).

For the light emitting period (T4), the OLED emits light by being supplied with the voltage stored in the first driving transistor (M1), i.e., a current ($I_{OLED}$) corresponding to a gate-source voltage ($V_{GS}$). This current ($I_{OLED}$) is obtained by Equation 1.

$$I_{OLED} = \frac{\beta}{2}(V_{GS} - V_{TH})^2 = \frac{\beta}{2}(V_{SG} - |V_{TH}|)^2 = \frac{\beta}{2}(V_{DD} - V_{DATA} - |V_{TH}|)^2 \quad \text{Equation 1}$$

$V_{TH}$ is a threshold voltage of the first driving transistor, and $V_{DATA}$ is a data voltage ($V_{DATA}$) of a data line (Data [m]), and $V_{DD}$ is a first voltage ($V_{DD}$) of the first voltage line ($ELV_{DD}$), and β is a constant.

Figure 5:
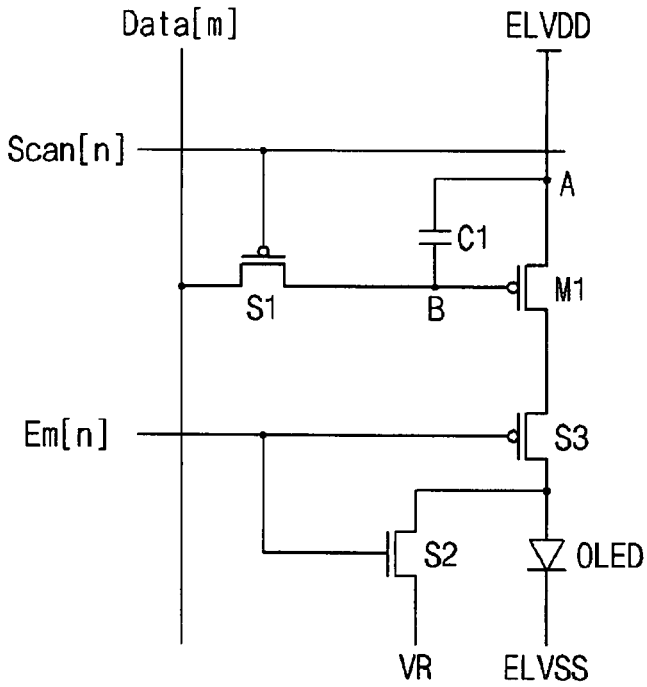
FIG. 5 is a circuit diagram of a pixel circuit of an organic electroluminescent display according to another exemplary embodiment of the present invention.

FIG. 5 is a circuit diagram of a pixel circuit of an organic electroluminescent display according to another exemplary embodiment of the present invention. The pixel circuit is one of the pixel circuits 141 of the organic electroluminescent display 100 of FIG. 2.

According to this exemplary embodiment of the present invention, the pixel circuit has the same configuration as the previous exemplary embodiment, except for a third switching element (S3) and a light emitting control signal line (Em [n]).

The third switching element (S3) includes a first electrode that is electrically coupled to a second electrode of the first driving transistor (M1), and a second electrode that is electrically coupled to an anode of an OLED, and a control electrode that is electrically coupled to a light emitting control signal line (Em [n]). The third switching element (S3) is turned on if a light emitting control signal of a low level is supplied to a control electrode through the light emitting control signal line (Em [n]), and a current of the first driving transistor flows to the OLED.

A control electrode of the second switching element (S2) is coupled to the light emitting control signal line (Em [n]) instead of to a prior scan line (Scan [n−1]). An N channel transistor is used instead of P channel transistor. However, the present invention is not limited thereto. Only, the second switching element uses a switching element that operates reversely to a different switching element.

Figure 6:
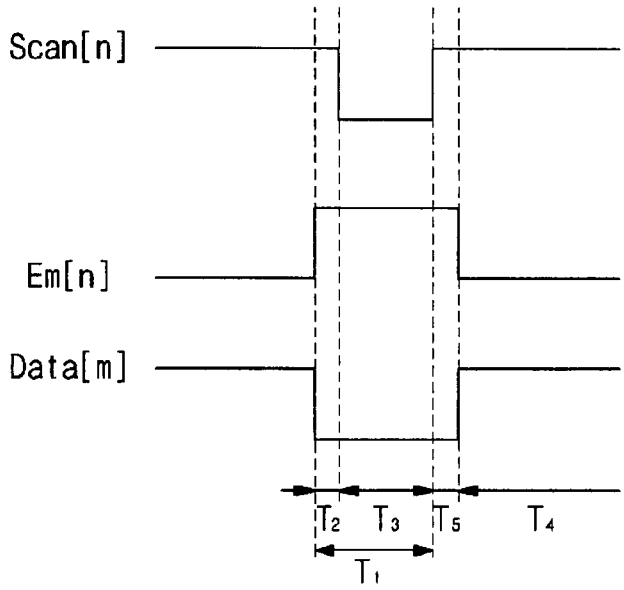
FIG. 6 is a waveform diagram of the driving timing of the pixel circuit of FIG. 5.

FIG. 6 is a waveform diagram of the driving timing of the organic electroluminescent display pixel circuit of FIG. 5.

For the negative bias period (T1), if a scan signal of a low level in a prior scan line (Scan [n−1]) is supplied to a control electrode of the second switching element, the second switching element (S2) is turned on and supplies the second voltage to the OLED. The second voltage makes the current reversely flow to the OLED by a negative voltage. Generally, when the OLED emits light, negative (−) carriers are located in an anode (ITO) and positive (+) carriers are located in a cathode (Metal) when a high voltage is supplied to an anode (ITO) and a low voltage is supplied to a cathode (Metal). Negative carriers and positive carriers stay but are not moved, an average luminance of the OLED is reduced by fixed carriers. To compensate for the decrease that the average luminance makes, the current reversely flows to the OLED, the fixed negative (−) and positive (+) carriers are reduced, and carriers which are moved to the emitting layer are increased. The light emitted by the OLED actively occurs because the fixed carriers are moved to the emitting layer (EML). As a result thereof, the decrease in the average luminance is compensated for.

For a delay period 1 (T2), a data voltage ($V_{DATA}$) of the data line (Data[m]) is changed to a data voltage ($V_{DATA}$) that corresponds to a pixel circuit connected to the scan line (Scan [n]) when a scan signal of the scan line (Scan [n]) is maintained at a high level. If there is no delay period 1(T2), the scan signal of the scan line (Scan[n]) is changed to a low level before a present data voltage is supplied, and the prior data voltage is supplied to the first driving transistor (M1) through the first switching element (S1).

A program period (T3) is included in the reverse bias period. If the scan signal of the scan line (Scan [n]) is changed to a low level, the first switching element (S1) is turned on. The data voltage ($V_{DATA}$) of the data line (Data[m]) is transmitted to the first driving transistor (M1) through the first switching element (S1). Coincidentally, the first capacitive element (C1) charges to a voltage that corresponds to a data voltage ($V_{DATA}$) difference with respect to the first voltage ($V_{DD}$) and the charged voltage is stored for certain period of time.

For a delay period 2 (T5), before the light emitting control signal of the light emitting control line (Em [n]) switches to a low level, the scan signal of the scan line (Scan [n]) switches to a high level and remains at a high level for a certain period of time. This prevents a delay phenomenon that can be produced by the delay of each element when the pixel circuit is operated.

For a light emitting period (T4), the third switching element (S3) is turned on when the scan signal of a low level of a light emitting control signal line (Em [n]) is supplied to a control electrode. The OLED emits light by being supplied with a voltage from the first driving transistor (M1), that is, a current ($I_{OLED}$) corresponding to a gate-source voltage ($V_{GS}$) of the first driving transistor (M1).

Figure 7:
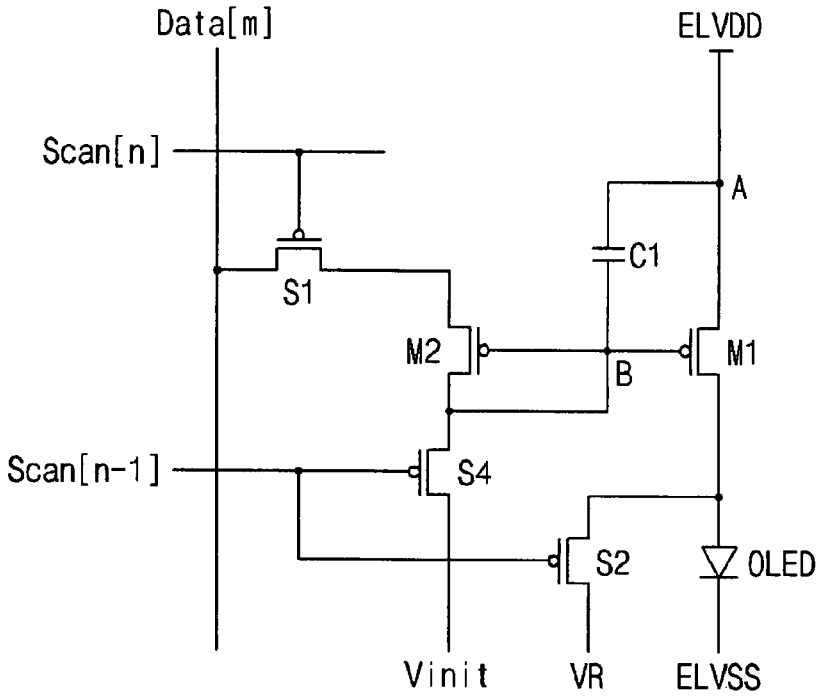
FIG. 7 is a circuit diagram of a pixel circuit of an organic electroluminescent display according to still another exemplary embodiment of the present invention.

FIG. 7 is a circuit diagram of a pixel circuit of the organic electroluminescent display according to still another exemplary embodiment of the present invention. The pixel circuit is one of the pixel circuits 141 of the organic electroluminescent display 100 of FIG. 2.

Referring to FIG. 7, the pixel circuit has a same configuration as the previous exemplary embodiment, except for a second driving transistor (M2) and a fourth switching element (S4).

The second driving transistor (M2) includes a first electrode that is electrically coupled to the first switching element (S1), and a second electrode and a control electrode that are electrically coupled to a control electrode of the first driving transistor (M1). That is, the second driving transistor is coupled to the first driving transistor in a diode configuration. This arrangement compensates for a threshold voltage ($V_{TH(1)}$) of the first driving transistor providing that the characteristics of the first and second driving transistor are the same. For example, in a manufacturing process of a transistor using a laser, transistors which are parallel to a laser scanning direction have similar electrical characteristics (e.g.-threshold voltage). Thus, if the first and the second driving transistor (M1 and M2) are formed parallel to the laser scanning direction, then their electrical characteristics are similar.

The fourth switching element (S4) includes a first electrode that is electrically coupled between the second electrode and the control electrode of the second driving transistor (M2), and a second electrode that is electrically coupled to the fourth voltage line (Vinit). The fourth switching element (S4) initializes a stored voltage in the first capacitive element when the fourth switching element (S4) is turned on. The fourth switching element (S4) further includes a control electrode that is electrically coupled to the prior scan line (Scan [n−1]).

Figure 8:
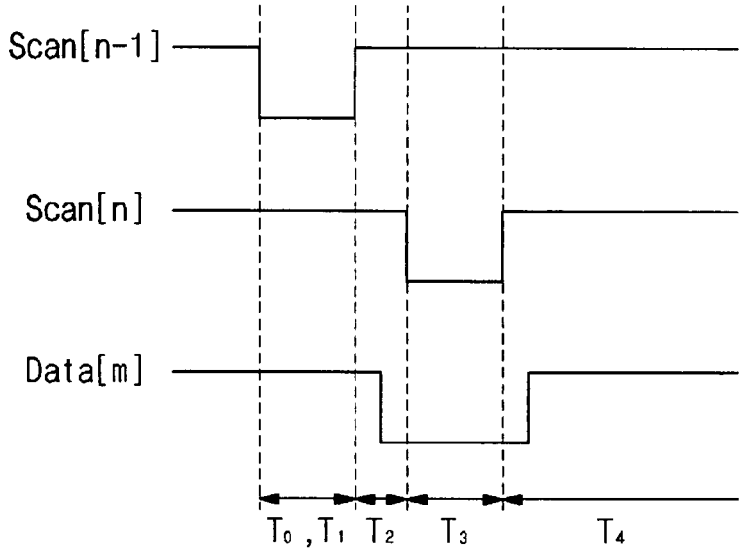
FIG. 8 is a waveform diagram of the driving timing of the pixel circuit of FIG. 7.

FIG. 8 is a timing diagram of the driving timing of the organic electroluminescent display pixel circuit of FIG. 7.

For an initializing period (T0), the fourth switching element (S4) is turned on when a scan signal of a low level is supplied from a prior scan line (Scan [n−1]). The fourth voltage (Vinit) is transferred to a control electrode of the first driving transistor (M1) by the fourth switching element (S4). The voltage for the control electrode of the first driving transistor, i.e., a voltage stored in the first capacitive element (C1) is initialized.

A reverse bias period (T1) occurs coincidentally with the initializing period (T0). For the reverse bias period (T1), if a scan signal of a low level in a prior scan line (Scan [n−1]) is supplied to the control electrode of the second switching element, then the second switching element (S2) is turned on and supplies the second voltage to the OLED. The second voltage causes a reverse current to flow to the OLED by a negative voltage. Generally, when the OLED emits light, negative (−) carriers are located in an anode (ITO) and positive (+) carriers are located in a cathode (Metal) when a high voltage is supplied to an anode (ITO) and a low voltage is supplied to a cathode (Metal). Negative carriers and positive carriers stay but are not moved, an average luminance of the OLED is reduced by fixed carriers. To compensate for the decrease that the average luminance makes, the current reversely flows to the OLED, the fixed negative (−) and positive (+) carriers are reduced, and carriers which are moved to the emitting layer are increased. The light emitted by the OLED actively occurs because the fixed carriers are moved to the emitting layer (EML). As a result thereof, the decrease in the average luminance is compensated for.

For the delay period 1 (T2), a scan signal of the prior scan line (Scan [n−1]) is changed from a low level to a high level when a scan signal of the scan line (Scan [n]) is maintained at a high level. During the delay period 1 (T2), the data voltage ($V_{DATA}$) of the data line (Data [m]) is changed to a data voltage ($V_{DATA}$) that corresponds to the pixel circuit connected to the scan line (Scan [n]). If there is no delay period 1 (T2), the scan signal of the scan line (Scan [n]) is changed to a low level before the present data voltage is supplied, and the prior data voltage is supplied to the first driving transistor (M1) through the first switching element (S1).

For the program period (T3), if the scan signal of the scan line (Scan [n]) is changed to a low level, the first switching element (S1) is turned on. The data voltage ($V_{DATA}$) of the data line (Data [m]) is transferred to the second driving transistor (M2). The first capacitive element (C1) charges to a voltage that corresponds to a voltage difference between the data voltage ($V_{DATA}$) and a threshold voltage ($V_{TH(2)}$) of the second driving transistor because the second driving transistor (M2) is in a diode configuration. The OLED emits light by being supplied with a current ($I_{OLED}$) that corresponds to a gate-source voltage ($V_{GS}$) of the first driving transistor (M1).

For the light emitting period (T4), the organic electroluminescent element emits light by being supplied with the voltage stored in the first capacitive element (C1), i.e., the current ($I_{OLED}$) corresponding to a gate-source voltage ($V_{GS}$) of the first driving transistor (M1). This current ($I_{OLED}$) is obtained by Equation 2.

$$I_{OLED} = \frac{\beta}{2}(V_{GS} - V_{TH(1)})^2 = \frac{\beta}{2}(V_{SG} - |V_{TH(1)}|)^2 = \frac{\beta}{2}[V_{DD} - (V_{DATA} - |V_{TH(2)}|) - |V_{TH(1)}|]^2 \quad \text{Equation 2}$$

$V_{TH(1)}$ is a threshold voltage of the first driving transistor, $V_{TH(2)}$ is a threshold voltage of the second driving transistor, and $V_{DATA}$ is a data voltage ($V_{DATA}$) of the data line (Data [m]), and $V_{DD}$ is the first voltage ($V_{DD}$) of the first voltage line ($ELV_{DD}$), and β is a constant.

If the threshold voltage of the first ($V_{TH(1)}$) and second ($V_{TH(2)}$) driving transistors are the same, Equation 2 is the same as Equation 3.

$$I_{OLED} = \frac{\beta}{2}(V_{DD} - V_{DATA})^2 \quad \text{Equation 3}$$

$V_{DATA}$ is a data voltage ($V_{DATA}$) of the data line (Data [m]), and $V_{DD}$ is the first voltage ($V_{DD}$) of the first voltage line ($ELV_{DD}$), and β is a constant.

The Current ($I_{OLED}$) is controlled by only the first voltage ($V_{DD}$) and the data voltage ($V_{DATA}$). Thus, a current which is independent of the threshold voltage of the first driving transistor flows to the OLED. Non-uniformity of the OLEDs are reduced by compensating for threshold voltage variations of the first driving transistor (M1).

Figure 9:
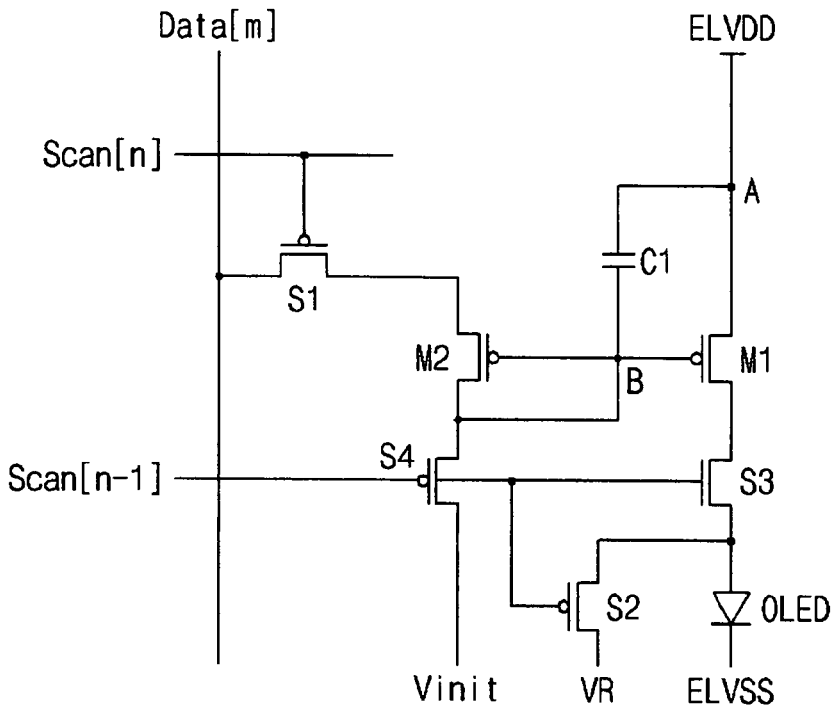
FIG. 9 is a circuit diagram of a pixel circuit of an organic electroluminescent display according to still another exemplary embodiment of the present invention.

FIG. 9 is a circuit diagram of a pixel circuit of the organic electroluminescent display according to still another exemplary embodiment of the present invention. The pixel circuit is one of the pixel circuits 141 of the organic electroluminescent display 100 of FIG. 2.

Referring to FIG. 9, the pixel circuit has same configuration as that of FIG. 7, except for a third switching element (S3).

The third switching element (S3) includes a first electrode that is electrically coupled to the second electrode of the first driving transistor (M1), and a second electrode that is electrically coupled to the first electrode of the second switching element (S2) and the anode of an OLED. The third switching element (S3) is turned on if a scan signal of a high level is supplied to a control electrode through the prior scan line (Scan [n−1]), and the current of the first driving transistor (M1) flows to the OLED.

The third switching element (S3) uses an N channel transistor instead of a P channel transistor. However, the present invention is not limited thereto. Only, the third switching element (S3) uses the switching element that operates reversely to a different switching element.

Figure 10:
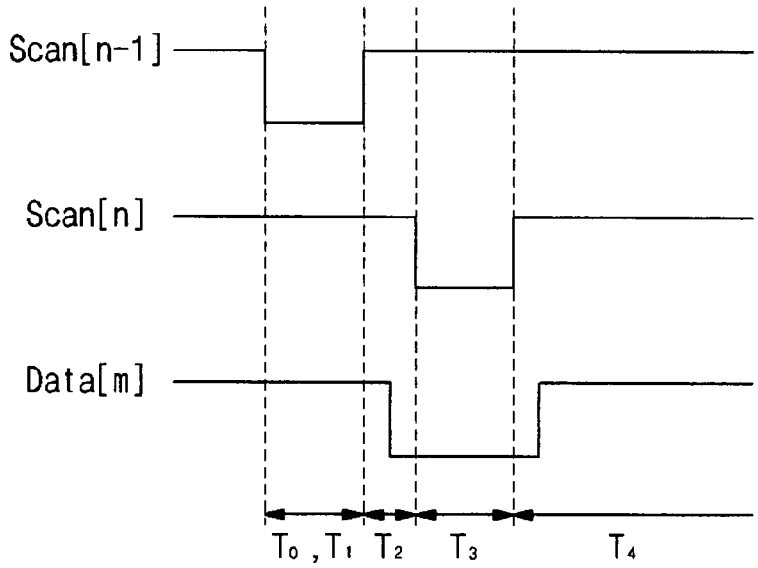
FIG. 10 is a waveform diagram of the driving timing of the pixel circuit of FIG. 9.

FIG. 10 is a timing diagram of driving timing of the organic electroluminescent display pixel circuit of FIG. 9.

For the initializing period (T0), the fourth switching element (S4) is turned on when a scan signal of a low level is supplied from the prior scan line (Scan [n−1]). The fourth voltage is transferred to the control electrode of the first driving transistor by the turned-on fourth switching element (S4). The voltage for the control electrode of the first driving transistor, i.e., the voltage stored in the first capacitive element (C1) is initialized.

The reverse bias period (T1) occurs coincidentally with the initializing period. For the reverse bias period (T1), if a scan signal of a low level in a prior scan line (Scan [n−1]) is supplied to the control electrode of the second switching element (S2), then the second switching element (S2) is turned on and thus supplies the second voltage to the OLED. The second voltage causes the current to reversely flow to the OLED by the negative voltage. Generally, when the OLED emits light, negative (−) carriers are located in an anode (ITO) and positive (+) carriers are located in a cathode (Metal) when a high voltage is supplied to an anode (ITO) and a low voltage is supplied to a cathode (Metal). Negative carriers and positive carriers stay but are not moved, an average luminance of the OLED is reduced by fixed carriers. To compensate for the decrease that the average luminance makes, the current reversely flows to the OLED, the fixed negative (−) and positive (+) carriers are reduced, and carriers which are moved to the emitting layer are increased. The light emitted by the OLED actively occurs because the fixed carriers are moved to the emitting layer (EML). As a result thereof, the decrease in the average luminance is compensated for.

For the delay period 1 (T2), the scan signal of the prior scan line (Scan [n−1]) is changed from a low level to a high level when a scan signal of the scan line (Scan [n]) is maintained at a high level. During the delay period 1(T2), the data voltage ($V_{DATA}$) of the data line (Data [m]) is changed to a data voltage that corresponds to the pixel circuit connected to the scan line (Scan [n]). If there is no delay period 1(T2), the scan signal of the scan line (Scan [n]) is changed to a low level before the present data voltage is supplied, and the prior data voltage is supplied to the first driving transistor through the first switching element (S1).

For the program period (T3), if the scan signal of the scan line (Scan [n]) is changed to a low level, the first switching element (S1) is turned on. The data voltage ($V_{DATA}$) of the data line (Data [m]) is transferred to the second driving transistor (M2). The first capacitive element (C1) charges to the voltage difference between the data voltage ($V_{DATA}$) and the threshold voltage ($V_{TH(2)}$) of the second driving transistor (M2) because the second driving transistor (M2) has a diode configuration. The third switching element (S3) is turned on when a high level scan line of the prior scan line (Scan [n−1]) is supplied to a control electrode, and then, the third switching element (S3) causes the OLED to emit light by supplying a current ($I_{OLED}$) that corresponds to the gate-source voltage ($V_{GS}$) to the OLED.

For the light emitting period (T4), the third switching element (S3) is turned on when a scan signal of a high level of the prior scan line (Scan [n−1]) is supplied to the control electrode, the OLED emits light by being supplied with the voltage stored in the first capacitive element (C1), i.e., the current ($I_{OLED}$) that corresponds to the gate-source voltage ($V_{GS}$) of the first driving transistor (M1).

Figure 11:
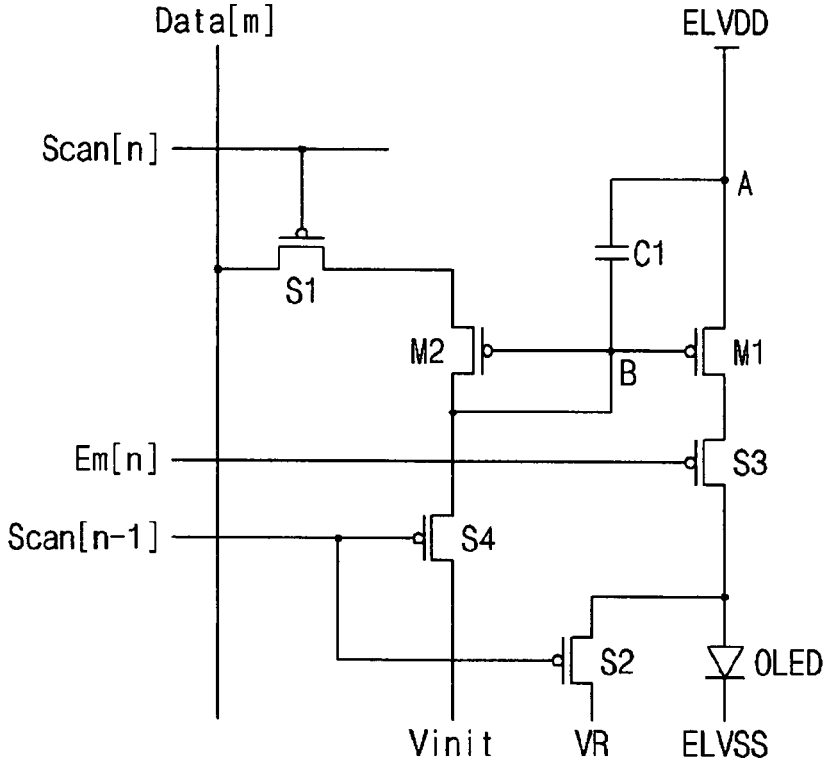
FIG. 11 is a circuit diagram of a pixel circuit of an organic electroluminescent display according to still another exemplary embodiment of the present invention.

FIG. 11 is a circuit diagram of a pixel circuit of an organic electroluminescent display according to still another exemplary embodiment of the present invention. The pixel circuit is one of the pixel circuits 141 of the organic electroluminescent display 100 of FIG. 2.

Referring to FIG. 11, the pixel circuit has same configuration as that of FIG. 7, except for the third switching element (S3) and the light emitting control line (Em [n]).

The light emitting control signal line controls the light emitting time of the OLED by being electrically coupled to a control electrode of the third switching element (S3). The light emitting control signal line (Em [n]) is electrically coupled to the light emitting control signal driver 130 for generating the light emitting control signal.

The third switching element (S3) includes a first electrode that is electrically coupled to a second electrode of the first driving transistor (M1), and a second electrode that is electrically coupled between the first electrode of the second switching element (S2) and the first electrode of the OLED. The third switching element (S3) is turned on if a scan signal of a low level is supplied to the control electrode through the light emitting control signal line (Em [n]), and the current of the first driving transistor (M1) flows to the OLED.

Figure 12:
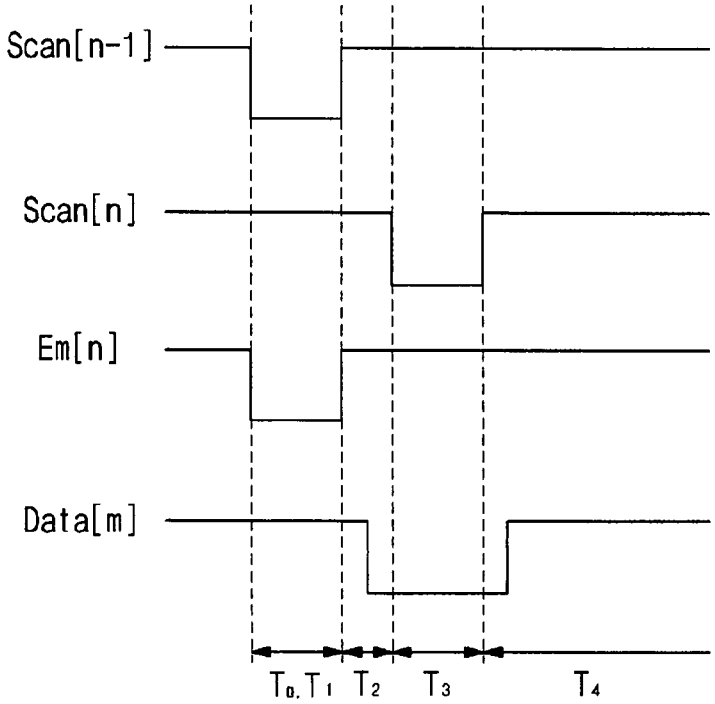
FIG. 12 is a waveform diagram of the driving timing of the pixel circuit of FIG. 11.

FIG. 12 is a timing diagram of the driving timing of the organic electroluminescent display pixel circuit of FIG. 11.

For the initializing period (T0), the fourth switching element (S4) is turned on when a scan signal of a low level is supplied from a prior scan line (Scan [n−1]). The fourth voltage is transferred to a control electrode of the first driving transistor (M1) by the turned-on fourth switching element (S4). The voltage for the control electrode of the first driving transistor (M1), i.e., the voltage stored in the first capacitive element (C1) is initialized.

The reverse bias period (T1) coincidentally occurs with the initialization period. For the reverse bias period (T1), if a scan signal of a low level in a prior scan line (Scan [n−1]) is supplied to the control electrode of the second switching element (S2), then the second switching element (S2) is turned on and supplies the second voltage to the OLED. The second voltage makes the current reversely flow to the OLED by a negative voltage. Generally, when the OLED emits light, negative (−) carriers are located in an anode (ITO) and positive (+) carriers are located in a cathode (Metal) when a high voltage is supplied to an anode (ITO) and a low voltage is supplied to a cathode (Metal). Negative carriers and positive carriers stay but are not moved, an average luminance of the OLED is reduced by fixed carriers. To compensate for the decrease that the average luminance makes, the current reversely flows to the OLED, the fixed negative (−) and positive (+) carriers are reduced, and carriers which are moved to the emitting layer are increased. The light emitted by the OLED actively occurs because the fixed carriers are moved to the emitting layer (EML). As a result thereof, the decrease in the average luminance is compensated for.

For a delay period 1 (T2), a scan signal of the prior scan line (Scan [n−1]) is changed from a low level to a high level when a scan signal of the scan line (Scan [n]) is maintained at a high level. During the delay period 1(T2), a data voltage of the data line (Data [m]) is changed to a data voltage that corresponds to a pixel circuit connected to the scan line (Scan [n]). If there is no delay period 1(T2), then the scan signal of the scan line (Scan [n]) changes to a low level before the present data voltage is supplied, and the prior data voltage supplied to the data line (Data [m]) is supplied to the first driving transistor (M1) through the first switching element (S1).

For the program period (T3), if the scan signal of the scan line (Scan [n]) is changed to a low level, the first switching element (S1) is turned on. The data voltage ($V_{DATA}$) of the data line (Data [m]) is transferred to the second driving transistor (M2). The first capacitive element (C1) charges to a voltage that corresponds to a voltage difference between the data voltage ($V_{DATA}$) and a threshold voltage ($V_{TH(2)}$) of the second driving transistor because the second driving transistor (M2) has a diode configuration. The OLED emits light by being supplied with a current ($I_{OLED}$) that corresponds to a gate-source voltage ($V_{GS}$) of the first driving transistor (M1).

For the light emitting period (T4), the third switching element (S3) is turned on when a scan signal of a low level of the light emitting control signal line (Em [n]) is supplied to the control electrode. The OLED emits light by being supplied with the voltage stored in the first capacitive element (C1), i.e., the current ($I_{OLED}$) that corresponds to a gate-source voltage ($V_{GS}$) of the first driving transistor (M1).

Figure 13:
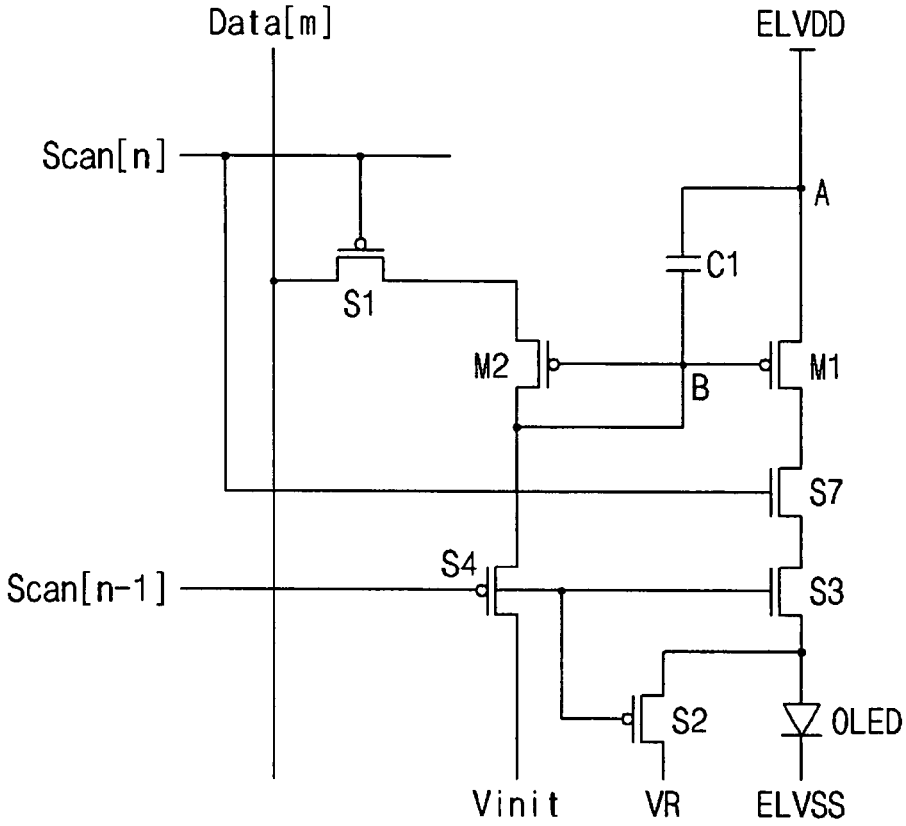
FIG. 13 is a circuit diagram of a pixel circuit of an organic electroluminescent display according to still another exemplary embodiment of the present invention.

FIG. 13 is a circuit diagram of a pixel circuit of an organic electroluminescent display according to still another exemplary embodiment of the present invention. The pixel circuit is one of the pixel circuits 141 of the organic electroluminescent display 100 of FIG. 2.

The pixel circuit has same configuration as that of FIG. 9, except for the seventh switching element (S7).

The seventh switching element (S7) includes a first electrode that is electrically coupled to a second electrode of the first driving transistor (M1), and a second electrode that is electrically coupled to a first electrode of the third switching element (S3). The seventh switching element (S7) is turned on if a scan signal of a high level is supplied to a control electrode through the scan line (Scan [n]). The current of the first driving transistor (M1) flows to the third switching element (S3), and the third switching element (S3) is turned on if a scan signal of a high level is supplied to the control electrode through the prior scan line (Scan [n−1]), and the third switching element (S3) causes a current to flow to the OLED. The third switching element (S3) and the seventh switching element (S7) use an N channel transistor instead of a P channel transistor. However, the present invention is not limited thereto. Only, the third switching element (S3) and the seventh switching element (S7) use switching elements that operates reversely to a different switching element.

Figure 14:
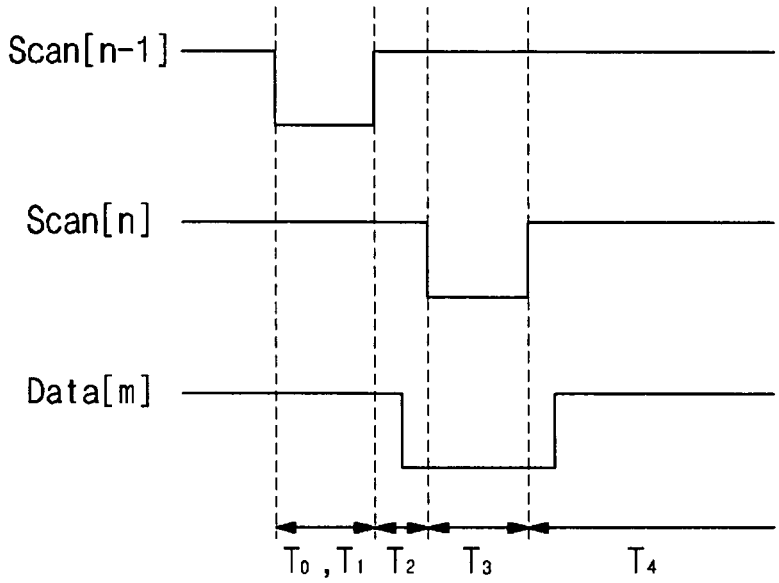
FIG. 14 is a waveform diagram of the driving timing of the pixel circuit of FIG. 13.

FIG. 14 is a timing diagram of the driving timing of the organic electroluminescent display pixel circuit of FIG. 13.

For the initializing period (T0), the fourth switching element (S4) is turned on when a scan signal of a low level is supplied from the prior scan line (Scan [n−1]). The fourth voltage is transferred to the control electrode of the first driving transistor (M1) by the turned-on fourth switching element (S4). The voltage for the control electrode of the first driving transistor, i.e., the voltage stored in the first capacitive element (C1) is initialized.

The reverse bias period (T1) coincidentally occurs with the initialization period. For the reverse bias period (T1), the second switching element (S2) includes the control electrode that supplies a scan signal of a low level in a prior scan line (Scan [n−1]), and the second switching element (S2) is turned on and supplies the second voltage to the OLED. The second voltage causes the current to reversely flow to the OLED by a negative voltage. Generally, when the OLED emits light, negative (−) carriers are located in an anode (ITO) and positive (+) carriers are located in a cathode (Metal) when a high voltage is supplied to an anode (ITO) and a low voltage is supplied to a cathode (Metal). Negative carriers and positive carriers stay but are not moved, an average luminance of the OLED is reduced by fixed carriers. To compensate for the decrease that the average luminance makes, the current reversely flows to the OLED, the fixed negative (−) and positive (+) carriers are reduced, and carriers which are moved to the emitting layer are increased. The light emitted by the OLED actively occurs because the fixed carriers are moved to the emitting layer (EML). As a result thereof, the decrease in the average luminance is compensated for.

For the delay period 1 (T2), the data voltage ($V_{DATA}$) of the data line (Data [m]) is changed to the data voltage corresponding to pixel circuit coupled to the scan line (Scan [n]) when a scan signal of the scan line (Scan [n]) is maintained to high level. If there is no delay period 1(T2), the scan signal of the scan line (Scan [n]) is changed to a low level before the present data voltage is supplied, and the prior data voltage is supplied to the first driving transistor (M1) through the first switching element (S1).

For program period (T3), if the scan signal of the scan line (Scan [n]) is changed to a low level, the first switching element (S1) is turned on. Thus, data voltage ($V_{DATA}$) of the data line (Data [m]) is transferred to the second driving transistor (M2) through the first switching element (S1). The first capacitive element (C1) charges to the voltage difference between the data voltage ($V_{DATA}$) and the threshold voltage ($V_{TH(2)}$) of the second driving transistor because the second driving transistor (M2) has a diode configuration. The scan signal of the scan line (Scan [n]) is changed to a low level, and the seventh switching element is turned off after the scan signal of the scan line (Scan [n]) is changed to a low level. The seventh switching element (S7) blocks current flow to the OLED although the third switching element (S3) is turned on.

The third switching element (S3) is turned on when a scan signal of a low level of the light emitting control signal line (Em [n]) is supplied to the control electrode. Thus, the OLED emits light by being supplied with a current ($I_{OLED}$) that corresponds to a gate-source voltage ($V_{GS}$) of the first driving transistor (M1).

For the light emitting period (T4), the seventh switching element is turned on after the scan signal of the scan line (Scan [n]) is changed to a high level. The third switching element (S3) is turned on after the scan signal of the scan line (Scan [n]) is changed to the high level. The OLED emits light by being supplied with the voltage from the first driving transistor (M1), i.e., the current ($I_{OLED}$) that corresponds to the gate-source voltage ($V_{GS}$) of the first driving transistor (M1).

Figure 15:
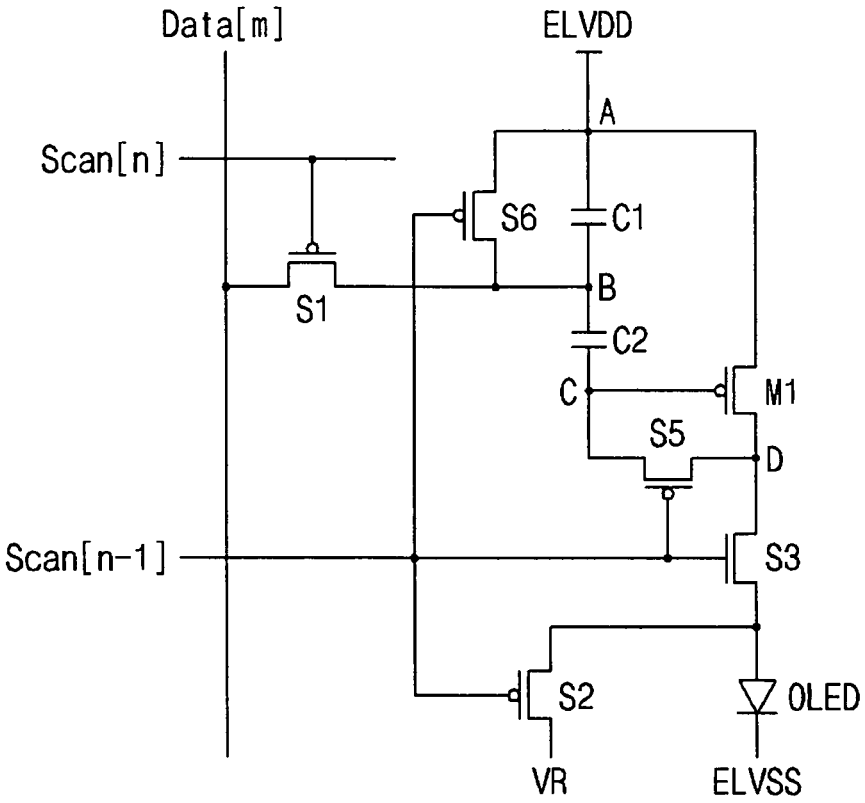
FIG. 15 is a circuit diagram of a pixel circuit of an organic electroluminescent display according to still another exemplary embodiment of the present invention.

FIG. 15 is a circuit diagram of a pixel circuit of the organic electroluminescent display according to still another exemplary embodiment of the present invention. The pixel circuit is one of the pixel circuits 141 of the organic electroluminescent display 100 of FIG. 2.

According to another exemplary embodiment of the present invention, the pixel circuit has same configuration as that of FIG. 2, except for the third switching element (S3), the fifth switching element (S5), the sixth switching element (S6), and the second capacitive element (C2).

The third switching element (S3) includes a first electrode that is electrically coupled to a second electrode of the first driving transistor (M1), and a second electrode that is electrically coupled between the first electrode of the second switching element (S2) and the anode of the OLED. The third switching element (S3) is turned on if a scan signal of a high level is supplied to the control electrode through the scan line (Scan [n]), and the current of the first driving transistor (M1) flows to the OLED. The third switching element (S3) uses an N channel transistor instead of a P channel transistor. However, the present invention is not limited thereto. Only, the third switching element (S3) and the seventh switching element (S7) use a switching element that operates reversely to a different switching element.

The fifth switching element (S5) includes a first electrode that is electrically coupled to the control electrode of the first driving transistor (M1), and a second electrode that is electrically coupled between the second electrode of the first driving transistor (M1) and the second electrode of the third switching element (S3). The first driving transistor (M1) is turned on by being supplied with the scan signal of a low level to the control electrode through the prior scan line (Scan[n−1]) using the fifth switching element S5, and thus can be coupled due to its diode configuration.

The sixth switching element (S6) includes a first electrode that is electrically coupled between the first voltage line (ELVDD) and the first electrode of the first capacitive element (C1), and a second electrode that is coupled to the second electrode of the first capacitive element (C1).

The sixth switching element (S6) is turned on if a scan signal of a low level is supplied to a control electrode through the prior scan line (Scan [n−1]), so as to supply the first voltage ($V_{DD}$) to a node B of the second capacitive element (C2).

The second capacitive element (C2) includes a first electrode that is electrically coupled between a second electrode of the first capacitive element (C1) and the second electrode of the first switching element (S1), and a second electrode that is electrically coupled between the control electrode of the first driving transistor (M1) and the first electrode of the fifth switching element (M5).

Figure 16:
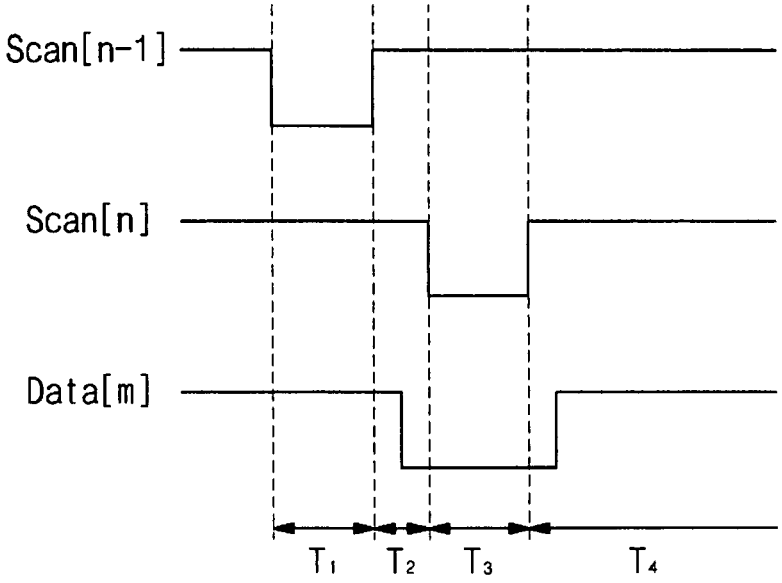
FIG. 16 is a waveform diagram of the driving timing of the pixel circuit of FIG. 15.

FIG. 16 is a timing diagram of the driving timing of the organic electroluminescent display pixel circuit as shown in FIG. 15.

For the negative bias period (T1), if a scan signal of low level in a prior scan line (Scan [n−1]) of the second switching element (S2) is supplied to a control electrode, the second switching element (S2) is turned on and supplies the second voltage to the OLED. The second voltage causes the current to reversely flow to the OLED by the negative voltage. Generally, when the OLED emits light, negative (−) carriers are located in an anode (ITO) and positive (+) carriers are located in a cathode (Metal) when a high voltage is supplied to an anode (ITO) and a low voltage is supplied to a cathode (Metal). Negative carriers and positive carriers stay but are not moved, an average luminance of the OLED is reduced by fixed carriers. To compensate for the decrease that the average luminance makes, the current reversely flows to the OLED, the fixed negative (−) and positive (+) carriers are reduced, and carriers which are moved to the emitting layer are increased. The light emitted by the OLED actively occurs because the fixed carriers are moved to the emitting layer (EML). As a result thereof, the decrease in the average luminance is compensated for.

The first driving transistor (M1) may be coupled to the diode structure as supplying the scan signal of the low level of a prior scan line (Scan [n−1]) to a control electrode of the fifth switching element (S5). The voltage difference between the first voltage ($V_{DD}$) and the threshold voltage (VTH) of the first driving transistor (M1) is supplied to a node C. The first voltage ($V_{DD}$) is supplied to a node B if a low level scan line is supplied to the control electrode of the sixth switching element (S6). A voltage of the nodes B and C is obtained by Equation 4.

$$V_{B(T1)}=V_{DD}$$

$$V_{C(T1)}=V_{DD}-|V_{TH}| \qquad \text{Equation 4}$$

$V_B$ indicates a voltage of the node B, $V_C$ indicates a voltage of the node C, $V_{DD}$ indicates a first voltage, $V_{TH}$ indicates the threshold voltage of the first driving transistor (M1).

Therefore, the threshold voltage of the first driving transistor (M1) is stored in the second capacitive element (C2).

For the delay period 1 (T2), the data voltage ($V_{DATA}$) of the data line (Data[m]) is changed to the data voltage ($V_{DATA}$) that corresponds to the pixel circuit connected to the scan line (Scan [n]) when a scan signal of the scan line (Scan [n]) is maintained at a high level. During the delay period 1(T2), the data voltage ($V_{DATA}$) of the data line (Data [m]) is changed to the data voltage ($V_{DATA}$) that corresponds to the pixel circuit connected to the scan line (Scan[n]). If there is no delay period 1(T2), the scan signal of the scan line (Scan[n]) is changed to a low level before the present data voltage is supplied, the prior data voltage is supplied to the first driving transistor (M1) through the first switching element (S1).

For the program period (T3), the scan signal of the scan line (Scan [n]) is changed to a low level, and the first switching element (S1) is turned on. The data voltage ($V_{DATA}$) of the data line (Data[m]) is supplied to the node B. The first capacitive element (C1) charges to a voltage that corresponds to the voltage difference between the data voltage ($V_{DATA}$) and the first voltage ($V_{DD}$).

If the first switching element (S1) is turned on, the data voltage ($V_{DATA}$) from a data line (Data[m]) is supplied to the node B. Therefore, the voltage of the node C, which is a floating status and faces node B, is changed by the variation amount of the voltage of the node B. The voltage of the node B indicates the voltage difference between the data voltage ($V_{DATA}$, voltage of node B in T3) and the first voltage ($V_{DD}$, voltage of node B in T1), i.e., the voltage variation supplied to the node B. The voltage of each node B and C is obtained by Equation 5.

$$V_{B(T3)} = V_{DATA} - V_{DD} \qquad \text{Equation 5}$$

$$V_{C(T3)} = (V_{DD} - |V_{TH}|) + (V_{DATA} - V_{DD}) = V_{DATA} - V_{TH}$$

$V_B$ indicates the voltage of the node B, $V_C$ indicates the voltage of the node C, $V_{DATA}$ indicates the data voltage, $V_{DD}$ indicates the first voltage, and $V_{TH}$ indicates the threshold voltage of the first driving transistor (M1). The voltage ($V_C$) of the node C indicates the sum of voltage ($V_{DD}-V_{TH}$) of the node C in the reverse bias period (T1), and a voltage variation ($V_{DATA}-V_{DD}$) of voltage in the program period (T3) of the node B ($V_B$) and the reverse bias period (T1).

For the light emitting period (T4), the third switching element (S3) is turned on when a scan signal of a high level in the prior scan line (Scan [n−1]) is supplied to the control electrode. The OLED emits light by being supplied with the voltage stored in the first capacitive element (C1), i.e., the current ($I_{OLED}$) that corresponds to the gate-source voltage ($V_{GS}$) of the first driving transistor (M1). The current is obtained by Equation 6.

$$I_{OLED} = \frac{\beta}{2}(V_{GS} - V_{TH})^2 = \frac{\beta}{2}(V_{SG} - |V_{TH}|)^2 = \frac{\beta}{2}(V_{DD} - V_{C(T3)} - |V_{TH}|)^2 = \frac{\beta}{2}[V_{DD} - (V_{DATA} - |V_{TH}|) - |V_{TH}|]^2 = \frac{\beta}{2}(V_{DD} - V_{DATA})^2 \quad \text{Equation 6}$$

$V_{C(T3)}$ indicates a voltage of a node C in program period (T3), VTH indicates the threshold voltage of the first driving transistor (M1), $V_{DATA}$ indicates the data voltage ($V_{DATA}$) of the data line (Data [m]), $V_{DD}$ indicates the first voltage ($V_{DD}$) of the first voltage line (ELVDD), and β indicates the constant value.

In Equation 6, the current ($I_{OLED}$) is controlled by only the first voltage ($V_{DD}$) and the data voltage ($V_{DATA}$). Thus, a current which is independent of the threshold voltage of the first driving transistor (M1) flows to the OLED. The non-uniformity of the OLED is reduced by compensating for threshold voltage variations of the first driving transistor (M1).

Figure 17:
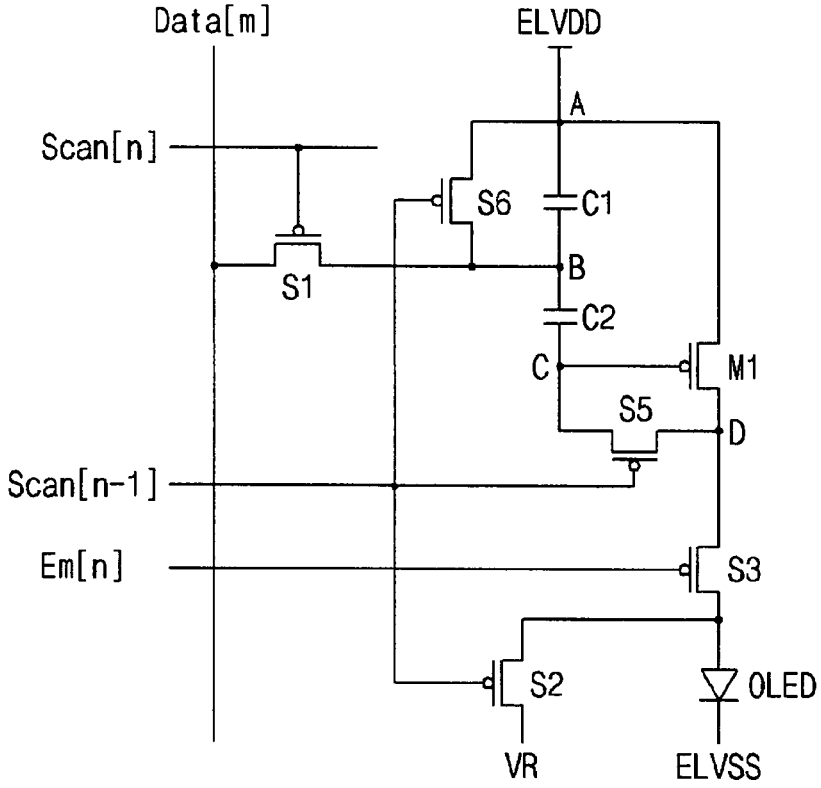
FIG. 17 is a circuit diagram of a pixel circuit of an organic electroluminescent display according to still another exemplary embodiment of the present invention.

FIG. 17 is a circuit diagram of a pixel circuit of the organic electroluminescent display according to still another exemplary embodiment of the present invention. The pixel circuit is one of the pixel circuits 141 of the organic electroluminescent display 100 of FIG. 2.

The pixel circuit has same configuration as that of FIG. 15, except for the third switching element (S3) and the light emitting control signal line (Em [n]).

The light emitting control signal line is electrically coupled to the control electrode of the third switching element (S3) to control the light emitting time of the OLED. The light emitting control signal line (Em [n]) is electrically coupled to the light emitting control signal driver (130) for generating the light emitting control signal.

The third switching element (S3) includes a first electrode that is electrically coupled to the second electrode of the first driving transistor (M1), and a second electrode that is electrically coupled between the first electrode of the second switching element (S2) and the first electrode of the OLED. The third switching element (S3) is turned on if a scan signal of a low level is supplied to the control electrode through the light emitting control signal line (Em [n]), and the current of the first driving transistor (M1) flows to the OLED.

Figure 18:
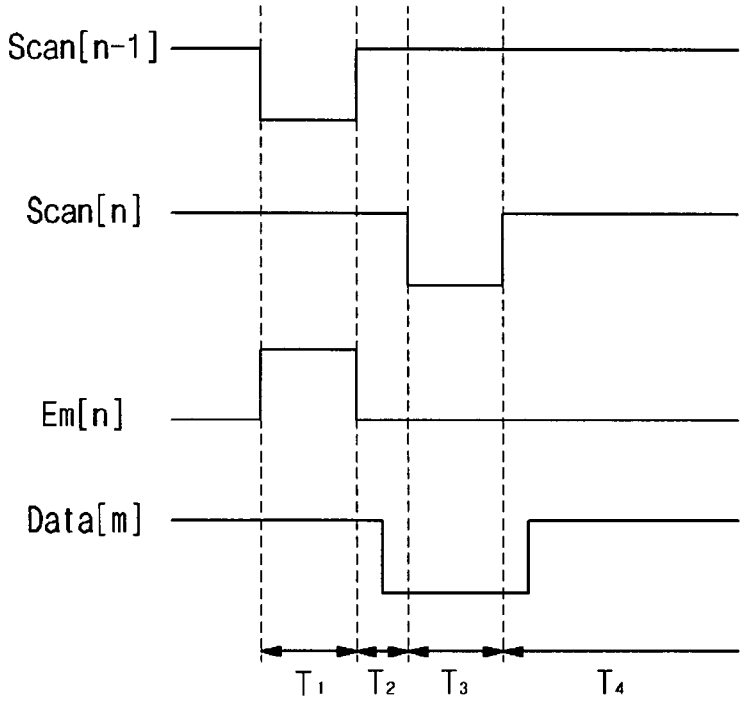
FIG. 18 is a waveform diagram of the driving timing of the pixel circuit of FIG. 17.

FIG. 18 is a timing diagram of the driving timing of the organic electroluminescent display pixel circuit as shown in FIG. 17. The operation of the pixel circuit of the organic electroluminescent display of FIG. 17 is the same as that of FIG. 15 and has therefore not been repeated.

Figure 19:
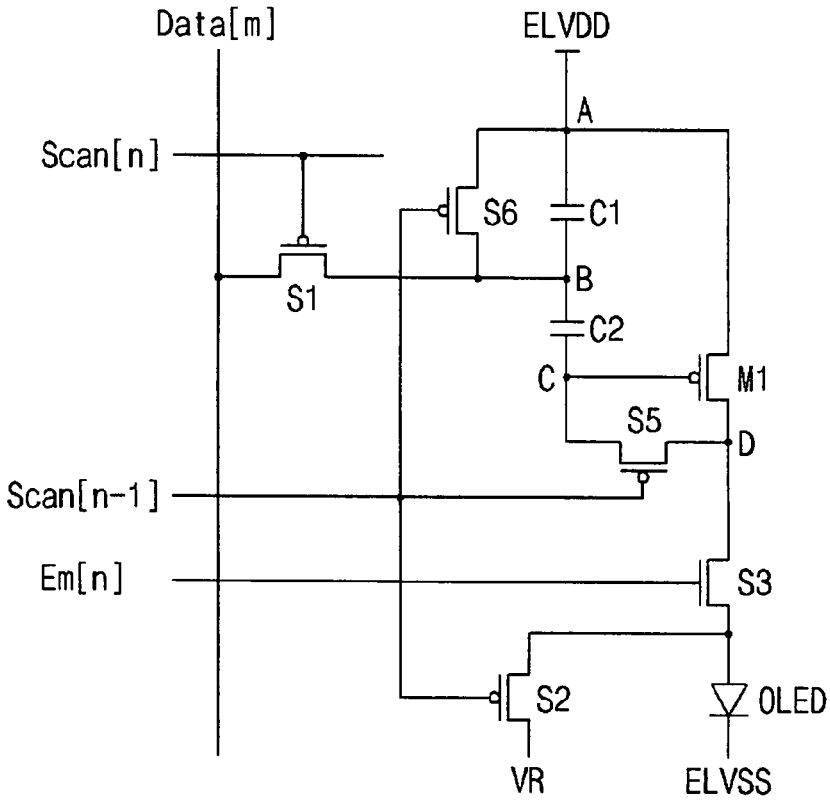
FIG. 19 is a circuit diagram of a pixel circuit of an organic electroluminescent display according to still another exemplary embodiment of the present invention.

FIG. 19 is a circuit diagram of a pixel circuit of the organic electroluminescent display according to still another exemplary embodiment of the present invention. The pixel circuit is one of the pixel circuits 141 of the organic electroluminescent display 100 of FIG. 2.

The pixel circuit has same configuration as that of FIG. 15, except for the third switching element (S3) and the light emitting control signal line (Em [n]).

The light emitting control signal line is electrically coupled to the control electrode of the third switching element (S3) to control the light emitting time of the OLED. The light emitting control signal line (Em [n]) is electrically coupled to the light emitting control driver (130) for generating a light emitting control signal.

Figure 20:
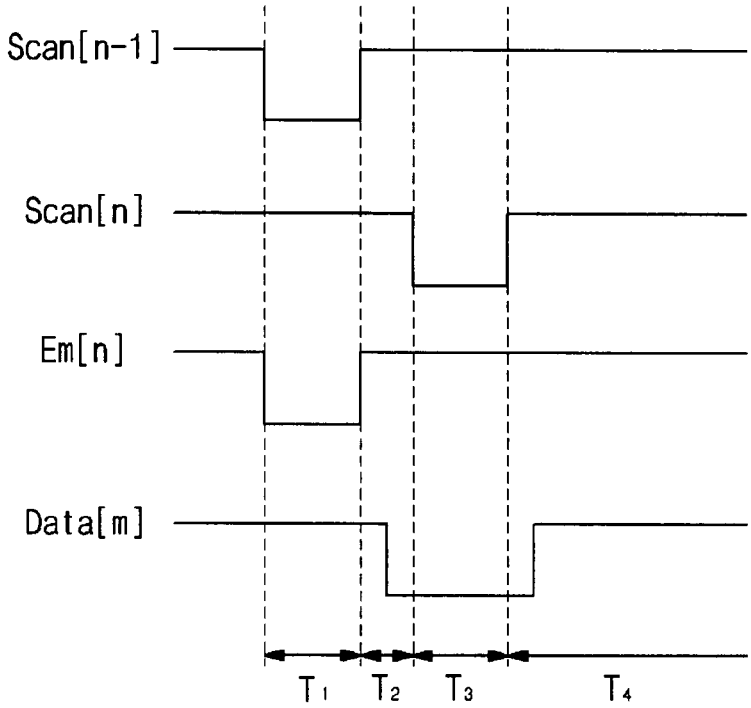
FIG. 20 is a waveform diagram of the driving timing of the pixel circuit of FIG. 19.

FIG. 20 is a timing diagram of the driving timing of the organic electroluminescent display pixel circuit as shown in FIG. 19. The operation of the pixel circuit of the organic electroluminescent display of FIG. 19 is the same as that of FIG. 15 and has therefore not been repeated.

Figure 21:
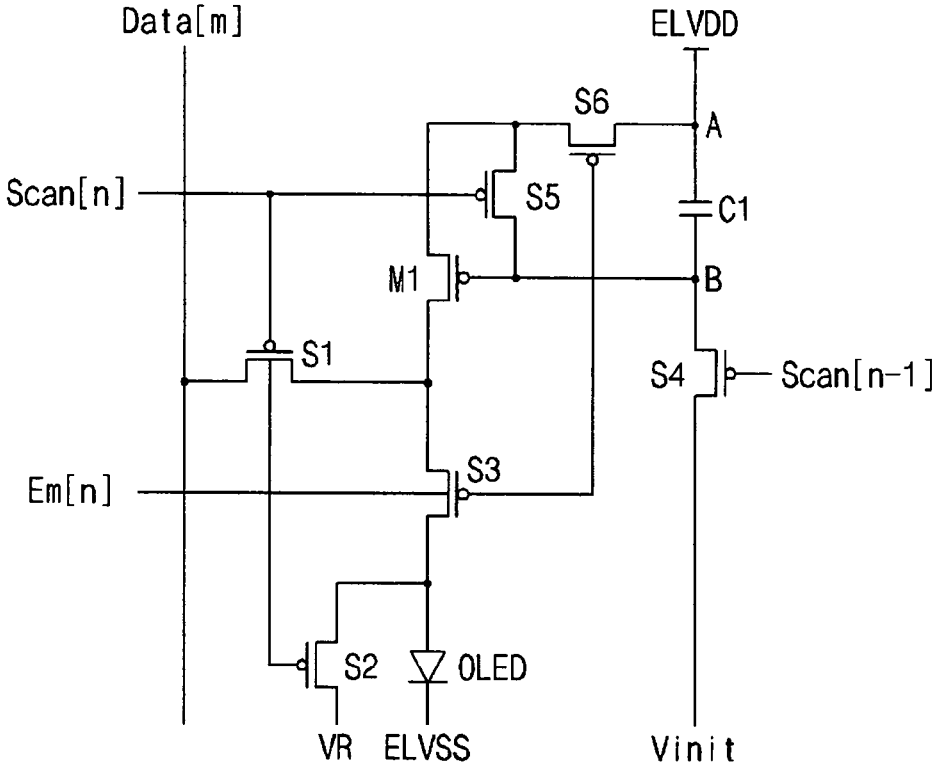
FIG. 21 is a circuit diagram of a pixel circuit of an organic electroluminescent display according to still another exemplary embodiment of the present invention.

FIG. 21 is a circuit diagram of a pixel circuit of the organic electroluminescent display according to still another exemplary embodiment of the present invention. The pixel circuit is one of the pixel circuits 141 of the organic electroluminescent display 100 of FIG. 2.

The pixel circuit has same configuration as that of FIG. 3, except for a light emitting control signal line (Em [n]), a first switching element (S1), a second switching element (S2), a third switching element (S3), a fourth switching element (S4), a fifth switching element (S5) and a sixth switching element (S6).

The first switching element (S1) includes a control electrode that is electrically coupled to the data line (Data[m]), and a second electrode that is electrically coupled to the second electrode of the first driving transistor (M1), and a control electrode that is electrically coupled to a scan line (Scan[n]). The data signal is supplied to the second electrode of the first driving transistor (M1) if the first switching element (S1) is turned on.

Practically, the light emitting control signal line is electrically coupled to the control electrode of the third switching element (S3) to control the light emitting time of the OLED. The light emitting control signal line (Em [n]) is electrically coupled to the light emitting control signal driver (130) for generating a light emitting control signal.

The second switching element (S2) includes a second electrode (drain electrode or source electrode) electrically coupled to the OLED, and a first electrode (source electrode or drain electrode) electrically coupled to the second voltage line (VR). If the second switching element (S2) is turned on by being supplied with a scan signal of a low level from the prior scan line (Scan [n−1]), then the second voltage is supplied to the OLED. The second voltage makes current reversely flow to the OLED by negative voltage. Generally, when the OLED emits light, negative (−) carriers are located in an anode (ITO) and positive (+) carriers are located in a cathode (Metal) when a high voltage is supplied to an anode (ITO) and a low voltage is supplied to a cathode (Metal). Negative carriers and positive carriers stay but are not moved, an average luminance of the OLED is reduced by fixed carriers. To compensate for the decrease that the average luminance makes, the current reversely flows to the OLED, the fixed negative (−) and positive (+) carriers are reduced, and carriers which are moved to the emitting layer are increased. The light emitted by the OLED actively occurs because the fixed carriers are moved to the emitting layer (EML). As a result thereof, the decrease in the average luminance is compensated for.

The third switching element (S3) includes a first electrode that is electrically coupled to the second electrode of the first driving transistor (M1), and a second electrode that is electrically coupled between a first electrode of the second switching element (S2) and the first electrode of the OLED. The third switching element (S3) is turned on if a scan signal of a low level is supplied to the control electrode through the light emitting control signal line (Em [n]), and the current of the first driving transistor (M1) flows to the OLED.

The fourth switching element (S4) includes a first electrode that is electrically coupled to a control electrode of the first driving transistor (M1), and a second electrode that is electrically coupled to the fourth voltage line (Vinit). The voltage stored in the first capacitive element is initialized when the fourth switching element (S4) is turned on. The control electrode of the fourth switching element (S4) is electrically coupled to the prior scan line (Scan [n−1]).

The fifth switching element (S5) includes a first electrode that is electrically coupled to the control electrode of the first driving transistor (M1), and a second electrode that is electrically coupled to the control electrode of the first driving transistor (M1). The first driving transistor (M1) is turned on by being supplied with a scan signal of a low level supplied to the control electrode through the prior scan line (Scan[n−1]) using the fifth switching element and coupled due to the diode configuration.

The sixth switching element (S6) includes a first electrode that is electrically coupled between the first voltage line (ELVDD) and the first electrode of the first capacitive element (C1), and a second electrode that is electrically coupled to the first electrode of the first capacitive element (C1). The sixth switching element (S6) is turned on if a scan signal of a low level is supplied to the control electrode through a light emitting control signal line (Em [n]), so as to supply the first voltage ($V_{DD}$) to the first driving transistor (M1).

Figure 22:
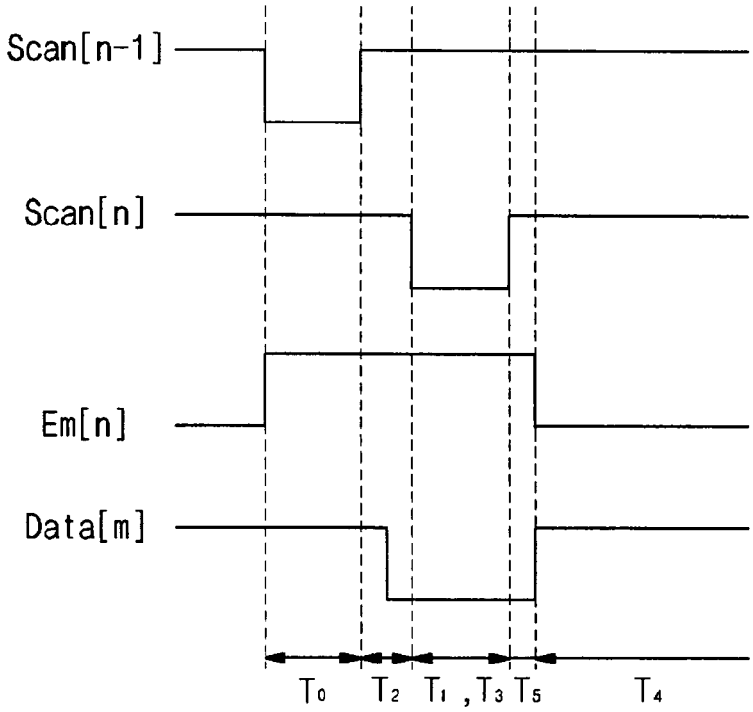
FIG. 22 is a waveform diagram of the driving timing of the pixel circuit of FIG. 21.

FIG. 22 is a timing diagram of the driving timing of the organic electroluminescent display pixel circuit as shown in FIG. 21.

For the initializing period (T0), the fourth switching element (S4) is turned on when a scan signal of a low level is supplied from the prior scan line (Scan [n−1]). The fourth voltage is transferred to the control electrode of the first driving transistor (M1) by the turned-on fourth switching element (S4). The voltage for the control electrode of the first driving transistor (M1), i.e., the voltage stored in the first capacitive element (C1) is initialized.

Next, a scan signal of the prior scan line (Scan [n−1]) is changed from a low level to a high level when a scan signal of a scan line (Scan [n]) is maintained at a high level for a delay period 1 (T2). If there is no delay period 1 (T2), the scan signal of the scan line (Scan [n]) is changed to a low level before the present data voltage is supplied, and the prior data voltage is supplied to the first driving transistor (M1) through the first switching element (S1).

For the reverse bias period (T1), if the second switching element (S2) is turned on by being supplied with scan signal of a low level in a prior scan line (Scan [n−1]) to a control electrode, the second voltage is supplied to the OLED. The second voltage causes the current to reversely flow to the OLED by the negative voltage. Generally, when the OLED emits light, negative (−) carriers are located in an anode (ITO) and positive (+) carriers are located in a cathode (Metal) when a high voltage is supplied to an anode (ITO) and a low voltage is supplied to a cathode (Metal). Negative carriers and positive carriers stay but are not moved, an average luminance of the OLED is reduced by fixed carriers. To compensate for the decrease that the average luminance makes, the current reversely flows to the OLED, the fixed negative (−) and positive (+) carriers are reduced, and carriers which are moved to the emitting layer are increased. The light emitted by the OLED actively occurs because the fixed carriers are moved to the emitting layer (EML). As a result thereof, the decrease in the average luminance is compensated for.

Next, the program period (T3) occurs coincidentally with the reverse bias period (T1). The first driving transistor (M1) is coupled in a diode configuration by supplying the scan signal of the scan line (Scan [n]) to the control electrode of the fifth switching element (S5). The voltage difference between the data voltage ($V_{DATA}$) and the threshold voltage (VTH) of the first driving transistor (M1) is supplied to the node B. The voltage of the node B is obtained by Equation 7 during the program period (T3).

$$V_{B(T3)}=V_{DATA}-|V_{TH}| \quad \text{Equation 7:}$$

For the delay period 2 (T5), a scan signal of the scan line (Scan [n]) is kept at a high level for a certain time before the light emitting control signal of the light emitting control signal line (Em [n]) changes to a low level. This is to prevent the delay of each element when each pixel circuit is operated.

For the light emitting period (T4), the first voltage is supplied to a control electrode of the first driving transistor (M1) when a scan signal of a low level of the light emitting control signal line (Em [n]) is supplied to the control electrode of the sixth switching element (S6). The OLED emits light by being supplied with the voltage stored in the first capacitive element (C1), i.e., the current ($I_{OLED}$) corresponding to the gate-source voltage ($V_{GS}$) of the first driving transistor (M1). The current ($I_{OLED}$) is obtained by Equation 8.

$$\begin{aligned} I_{OLED} &= \frac{\beta}{2}(V_{GS}-V_{TH})^2 = \frac{\beta}{2}(V_{SG}-|V_{TH}|)^2 \\ &= \frac{\beta}{2}(V_{DD}-(V_{DATA}-|V_{TH}|)-|V_{TH}|)^2 \\ &= \frac{\beta}{2}(V_{DD}-V_{DATA})^2 \end{aligned} \quad \text{Equation 8}$$

$V_{TH}$ indicates the threshold voltage of the first driving transistor (M1), $V_{DATA}$ indicates the data voltage ($V_{DATA}$) of the data line (Data [m]), $V_{DD}$ indicates the first voltage ($V_{DD}$) of the first voltage line (ELVDD), and β indicates a constant.

In Equation 7, the current ($I_{OLED}$) will be controlled by only the first voltage ($V_{DD}$) and data voltage ($V_{DATA}$). Thus, a current which is independent of the threshold voltage of the first driving transistor (M1) flows to the OLED. The non-uniformity of the OLED is reduced by compensating for threshold voltage variations of the first driving transistor (M1).

Figure 23:
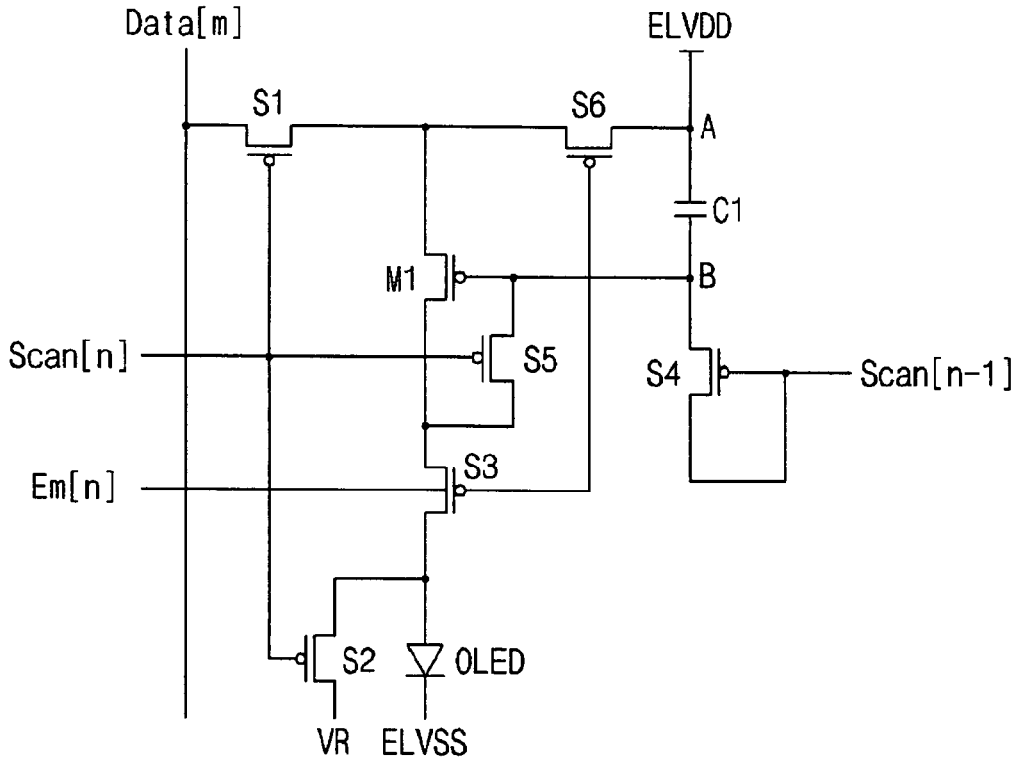
FIG. 23 is a circuit diagram of a pixel circuit of an organic electroluminescent display according to still another exemplary embodiment of the present invention.

FIG. 23 is a circuit diagram of a pixel circuit of the organic electroluminescent display according to still another exemplary embodiment of the present invention. The pixel circuit is one of the pixel circuits 141 of the organic electroluminescent display 100 of FIG. 2.

The pixel circuit has same configuration as that of FIG. 10, except for a first switching element (S1), a fourth switching element (S4), and a fifth switching element (S5).

The first switching element (S1) includes a control electrode that is electrically coupled to the data line (Data[m]), and a second electrode that is electrically coupled to the second electrode of the first driving transistor (M1), and a control electrode that is electrically coupled to a scan line (Scan[n]). The data signal is supplied to the second electrode of the first driving transistor (M1) if the first switching element (S1) is turned on.

The fourth switching element (S4) includes a first electrode that is electrically coupled to a second electrode of the first driving transistor (M1), and a second electrode and a control electrode that are electrically coupled to a prior scan line (Scan [n−1]) in a diode configuration. If the fourth switching element (S4) is turned on, the voltage stored in the first capacitive element can be initialized.

The fifth switching element (S5) includes a first electrode that is electrically coupled to the control electrode of the first driving transistor (M1), and the second electrode that is electrically coupled to a second electrode of the first driving transistor (M1). The fifth switching element (S5) is turned on if a scan signal of a low level is supplied to the control electrode through the prior scan line (Scan [n−1]) and the first driving transistor (M1) has a diode configuration.

The fifth switching element includes a first electrode electrically coupled to the control electrode of the first driving transistor (M1), and a second electrode coupled between the second electrode of the first driving transistor (M1) and the first electrode of the third switching element (C3).

Figure 24:
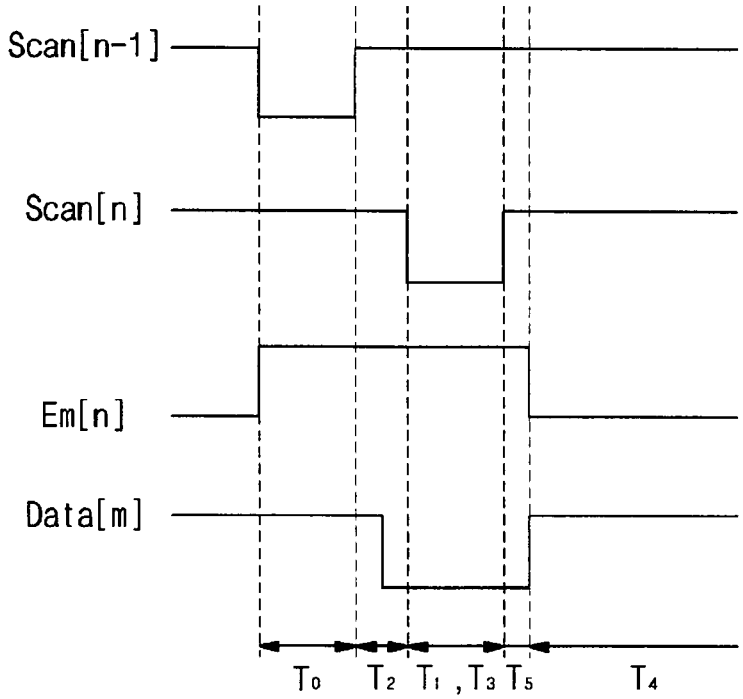
FIG. 24 is a waveform diagram of the driving timing of the pixel circuit of FIG. 23.

FIG. 24 is a timing diagram of the driving timing of the organic electroluminescent display pixel circuit of FIG. 23. The operation of the pixel circuit of the organic electroluminescent display of FIG. 23 is the same as that of FIG. 21, except for the initializing period (T0).

For the initializing period (T0), the fourth switching element (S4) is turned on when a scan signal of a low level is supplied from the prior scan line (Scan [n−1]). The fourth voltage is transferred to the control electrode of the first driving transistor (M1) by the turned-on fourth switching element (S4). The voltage for the control electrode of the first driving transistor (M1), i.e., the voltage stored in the first capacitive element (C1) is initialized.

Figure 25:
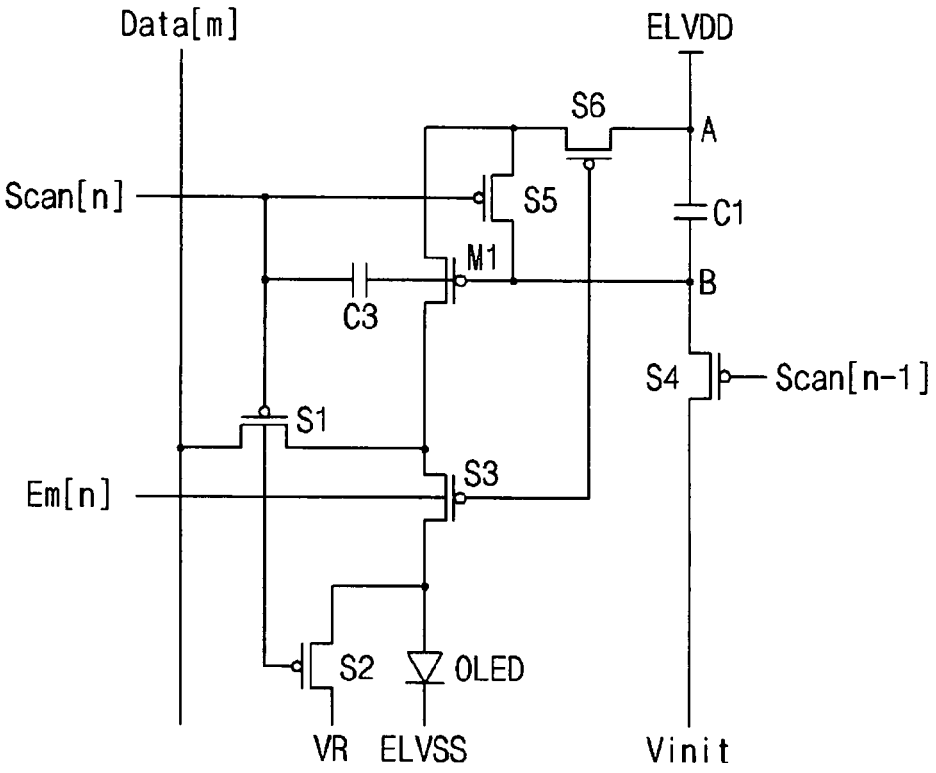
FIG. 25 is a circuit diagram of a pixel circuit of an organic electroluminescent display according to still another exemplary embodiment of the present invention.

FIG. 25 is a circuit diagram of a pixel circuit of the organic electroluminescent display according to still another exemplary embodiment of the present invention. The pixel circuit is one of the pixel circuits 141 of the organic electroluminescent display 100 of FIG. 2.

The pixel circuit has same configuration as that of FIG. 23, except for a third capacitive element (C3).

The third capacitive element (C3) includes a first electrode that is electrically coupled between the scan line (Scan [n]) and a control electrode of the first switching element (S1), and a second electrode that is electrically coupled to a control electrode of the first driving transistor (M1).

The first voltage for driving the pixel circuit has to be the same or lower than a maximum gray scale voltage of the data voltage. The first voltage of the first voltage line (ELVDD) has to be lower voltage when a data voltage is the maximum gay scale voltage (black voltage). A third voltage of the third voltage line (ELVSS) is fallen since the driving voltage of the OLED has to be kept constant.

That is, the first voltage cannot be set to more than 5V because the maximum gray scale voltage (black voltage) of the data voltage is about 5V. Therefore, the third voltage has to have a negative value of −6V to keep voltage difference as 11V between the first voltage and the third voltage. In that case, the total efficiency is reduced since the efficiency of a DC/DC converter for supplying the first and the third voltage is reduced relatively. To increase the efficiency of the DC/DC converter, it is desirable to have a range of positive voltage for both the first voltage and the third voltage.

To compensate for this, the third capacitive element (C3) is added. The third capacitive element (C3) increases the voltage for the control electrode of the first driving transistor (M1). The voltage of the control electrode is the sum of the data voltage and threshold voltage.

Figure 26:
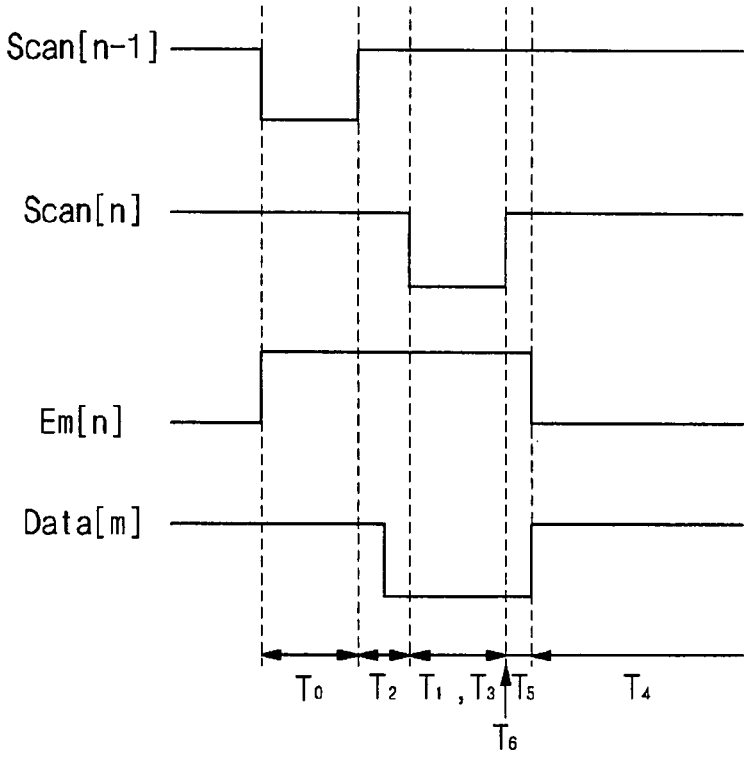
FIG. 26 is a waveform diagram of the driving timing of the pixel circuit of FIG. 25.

FIG. 26 is a timing diagram of the driving timing of the organic electroluminescent display pixel circuit as shown in FIG. 25. The operation of the pixel circuit of the organic electroluminescent display of FIG. 25 is the same as that of FIG. 23, except for the program period (T3) and a point in time of DC/DC efficiency compensation (T6).

In the program period (T3), an amount of charge stored in the capacitor is the same because the first capacitive element (C1) and the third capacitive element (C3) are connected in series. That is, ΔC1=ΔC3.ΔC1 is a variable value of electrical charges of the first capacitive element (C1) and ΔC3 is a variable value of the electrical charges of the third capacitive element (C3). The variable values are obtained by Equation 9.

$$\Delta C_1 = \Delta C_2 \qquad \text{Equation 9}$$

$$C_1[(V_{DD} - V_{DATA}) - (V_{DD} - V_B)] = C_3[(V_{DATA} - V_{SL}) - (V_B - V_{SH})]$$

$V_{DATA}$ indicates the data voltage ($V_{DATA}$) of the data line (Data [m]), $V_{DD}$ indicates the first voltage ($V_{DD}$) of the first voltage line (ELVDD), and $V_B$ indicates the voltage value of the node B, $V_{SL}$ indicates a scan signal of the low level, and $V_{SH}$ indicates a scan signal of the high level.

The voltage of the node B which is supplied to the control electrode of the first driving transistor (M1) is obtained by Equation 10.

$$V_B = V_{DATA} + C_3\frac{(V_{SH} - V_{SL})}{(C_1 + C_3)} \qquad \text{Equation 10}$$

Therefore, the voltage of the node B ($V_B$) has a voltage which adds a corrected voltage (V3=C1(VSH−VSL)/(C1+C3) to the data voltage ($V_{DATA}$) using the third capacitive element (C3).

In the time point of DC/DC efficiency compensation (T6), the voltage (voltage of a node B) for the control electrode of the first driving transistor (M1) is the same as equation 10 when a scan line (Scan [n]) is changed from a low level to a high level. At this time point, the current ($I_{OLED}$) flowing to the first driving transistor (M1) is obtained by Equation 11.

$$\begin{aligned} I_{OLED} &= \frac{\beta}{2}(V_{GS} - V_{TH})^2 \\ &= \frac{\beta}{2}(V_{SG} - |V_{TH}|)^2 \\ &= \frac{\beta}{2}(V_{DD} - V_{DATA} + V_3 - |V_{TH}|)^2 \end{aligned} \qquad \text{Equation 11}$$

At this time point, the compensation voltage ($V_3$) is equal to the maximum gray scale voltage (black voltage). Therefore, the compensation voltage ($V_3$) is also set to 5V if the gray scale voltage (black voltage) is 5V. Thus, the first and third voltages have a range of positive voltages. Then, the efficiency of a DC/DC converter for supplying power is increased.

Figure 27:
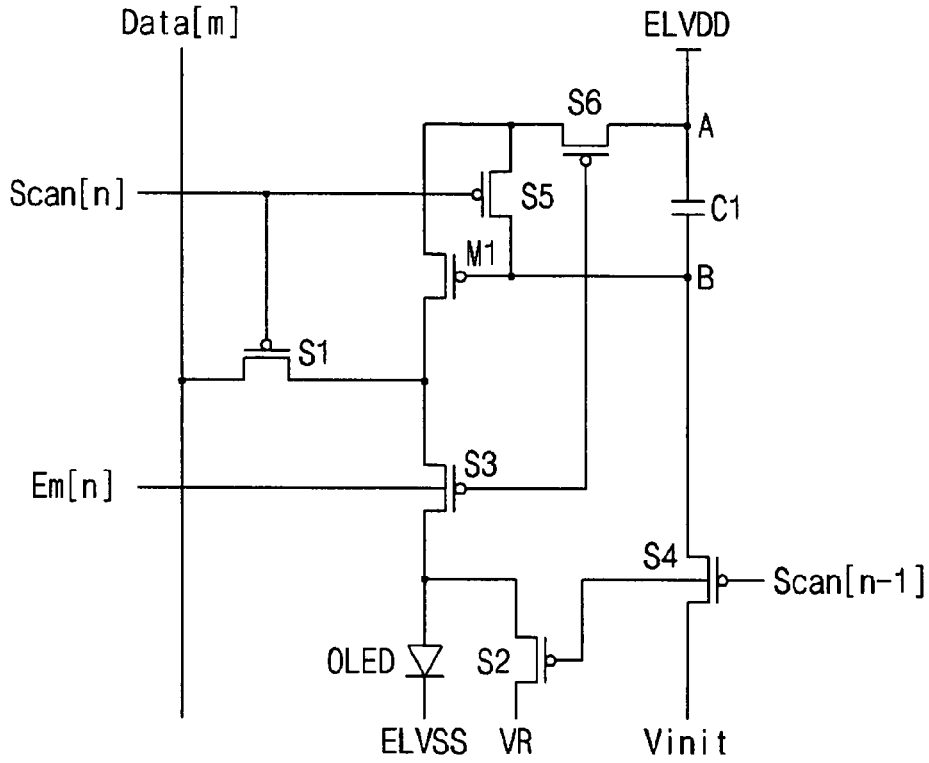
FIG. 27 is a circuit diagram of a pixel circuit of an organic electroluminescent display according to still another exemplary embodiment of the present invention.
Figure 28:
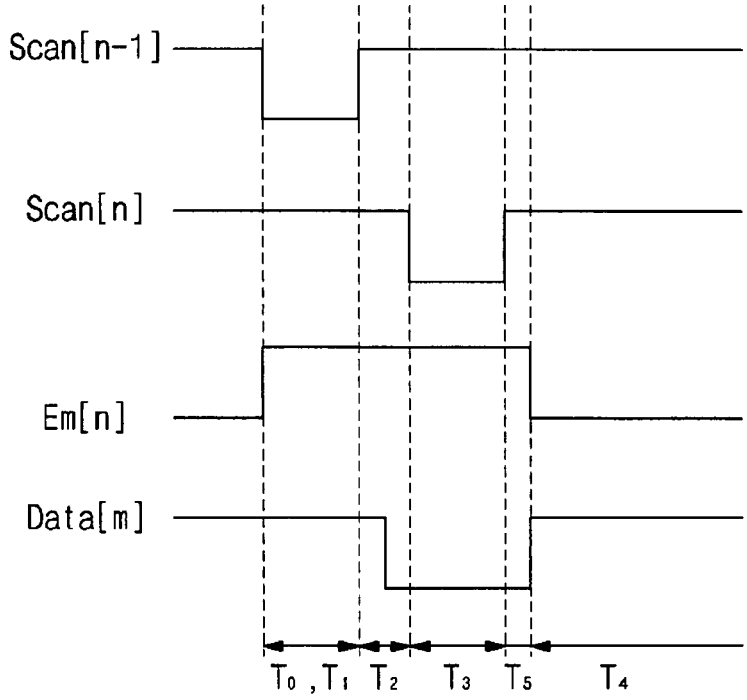
FIG. 28 is a waveform diagram of the driving timing of the pixel circuit of FIG. 27.
Figure 29:
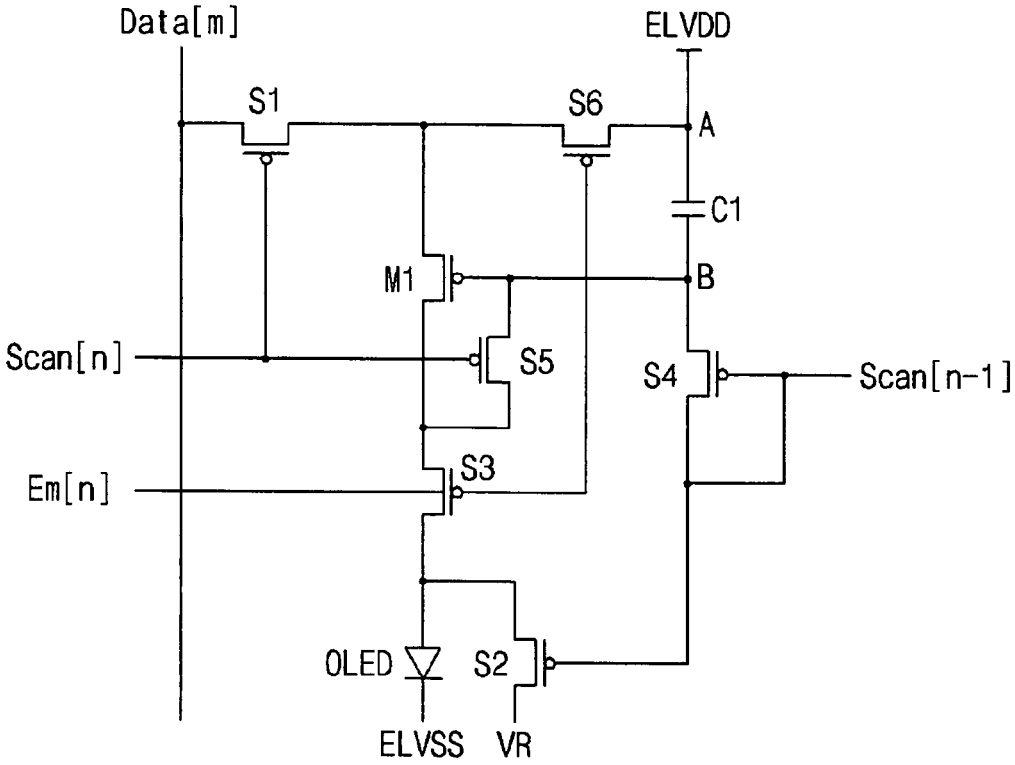
FIG. 29 is a circuit diagram of a pixel circuit of an organic electroluminescent display according to still another exemplary embodiment of the present invention.
Figure 30:
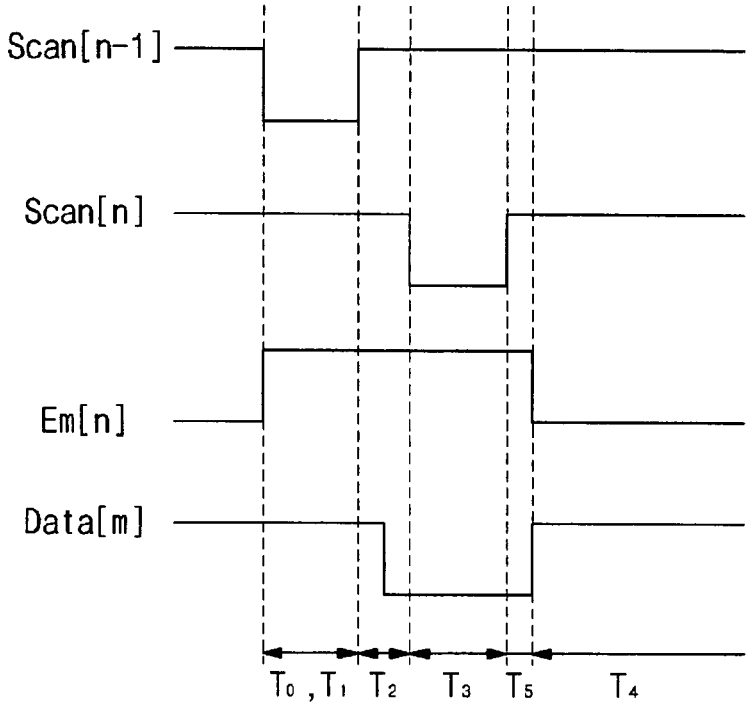
FIG. 30 is a waveform diagram of the driving timing of the pixel circuit of FIG. 29.
Figure 31:
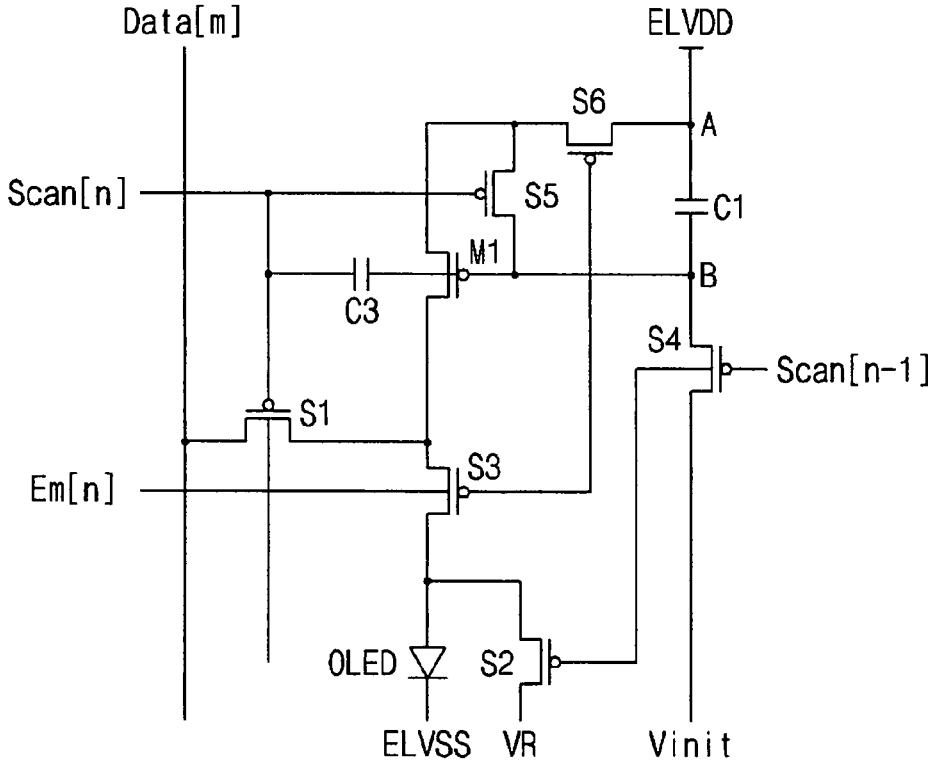
FIG. 31 is a circuit diagram of a pixel circuit of an organic electroluminescent display according to still another exemplary embodiment of the present invention.
Figure 32:
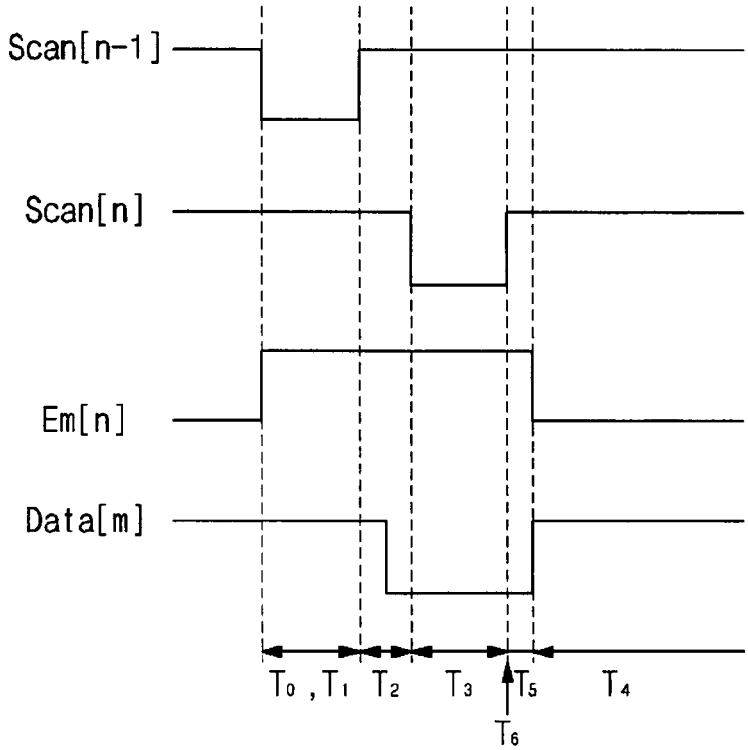
FIG. 32 is a waveform diagram of the driving timing of the pixel circuit of FIG. 31.

FIG. 27, FIG. 29 and FIG. 31 have the same configuration as FIG. 21, FIG. 23 and FIG. 25, except for connecting the prior scan line (Scan [n−1]) to the second switching element (S2) of FIG. 21, FIG. 23 and FIG. 25 instead of scan line (Scan [n]). In FIG. 22, FIG. 24 and FIG. 26, the reverse bias period (T1) and program period (T3) occur for the same period, and In FIG. 28, FIG. 30 and FIG. 32, the reverse bias period (T1) and program period (T3) occur for the same period.

As described above, the organic electroluminescent display according to the present invention produces the following effect.

The organic electroluminescent display can compensate the average luminance by causing a reverse current to flow into the OLED.

It should be understood by those of ordinary skill in the art that various replacements, modifications and changes in form and detail may be made therein without departing from the spirit and scope of the present invention as defined by the following claims. Therefore, it is to be appreciated that the above described embodiments are for purposes of illustration only and are not to be construed as being limitations of the present invention.

What is claimed is:

1. An organic electroluminescent display comprising:

a data driver sequentially supplying a data signal through a plurality of data lines;

a scan driver sequentially supplying a scan signal through a plurality of scan lines, the plurality of scan lines comprising a current scan line and a prior scan line;

a first switching element including a control electrode, electrically coupled to the current scan line, to transfer the data signal from the data line;

a first driving transistor including a control electrode, electrically coupled to the first switching element, to control a driving current of a first voltage line;

a first capacitive element including a first electrode electrically coupled to the first voltage line and a second electrode electrically coupled to a control electrode of the first driving transistor;

an organic electroluminescent element, electrically coupled to the first driving transistor and to a third voltage line, to display an image in response to being supplied with a current from the first driving transistor;

a second voltage line to supply a reverse bias voltage from a second voltage line to the organic electroluminescent element; and a second switching element driven by signals from the prior scan time, the second switching element including a first electrode electrically coupled between the first driving transistor and the organic electroluminescent element, and a second electrode electrically coupled to the second voltage line;

wherein the second switching element further includes a control electrode electrically coupled to and having a conductive state directly responsive to the prior scan line.

2. The organic electroluminescent display of claim 1, wherein a voltage of the second voltage line is less than that of the third voltage line.

* * * * *